US009809033B2

(12) United States Patent
Matsuda et al.

(10) Patent No.: US 9,809,033 B2
(45) Date of Patent: Nov. 7, 2017

(54) LIQUID CONTAINER AND LIQUID EJECTION APPARATUS

(71) Applicant: SEIKO EPSON CORPORATION, Tokyo (JP)

(72) Inventors: Takanori Matsuda, Nagano (JP); Shoma Kudo, Nagano (JP); Munehide Kanaya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/296,379

(22) Filed: Oct. 18, 2016

(65) Prior Publication Data

US 2017/0113467 A1 Apr. 27, 2017

(30) Foreign Application Priority Data

Oct. 21, 2015 (JP) ..... 2015-206948

(51) Int. Cl.
*B41J 2/175* (2006.01)

(52) U.S. Cl.
CPC ..... *B41J 2/17553* (2013.01); *B41J 2/17503* (2013.01); *B41J 2/17513* (2013.01); *B41J 2/1753* (2013.01); *B41J 2/17556* (2013.01)

(58) Field of Classification Search
CPC B41J 2/17553; B41J 2/17503; B41J 2/17513; B41J 2/17556; B41J 2/1753; B41J 2/175523
See application file for complete search history.

(56) References Cited

U.S. PATENT DOCUMENTS 5,682,189 A * 10/1997 Takagi ..... B41J 2/17513 347/87
6,431,696 B1 * 8/2002 Tajima ..... B41J 2/17513 347/86
2015/0367648 A1 * 12/2015 Kimura ..... B41J 2/17509 347/86
2016/0009096 A1 * 1/2016 Suzuki ..... B41J 2/175 347/86
2016/0009100 A1 * 1/2016 Kudo ..... B41J 2/17553 347/92
2016/0016409 A1 * 1/2016 Kimura ..... B41J 2/17523 347/86

FOREIGN PATENT DOCUMENTS

CN 104015492 A 9/2014

* cited by examiner

*Primary Examiner* — Henok Legesse
(74) *Attorney, Agent, or Firm* — Global IP Counselors, LLP

(57) ABSTRACT

A liquid container including: a liquid container part; a liquid injection part; an air introduction part; and a buffer part that is in communication with the liquid container part via a first communication path, and in communication with the air introduction part via a second communication path. the buffer part, when the liquid container is in a second orientation that is rotated from the first orientation by 180°, is configured to store the liquid having a volume that is equal to or larger than a volume of the liquid in the liquid container part such that a surface of the liquid is located below a second opening end of the first communication path in the buffer part and a third opening end of the second communication path in the buffer part.

20 Claims, 31 Drawing Sheets

LIQUID CONTAINER AND LIQUID EJECTION APPARATUS

CROSS REFERENCE TO RELATED APPLICATION

This application claims priority to Japanese Patent Application No. 2015-206948 filed on Oct. 21, 2015, the entire contents of this application are incorporated by reference herein.

BACKGROUND

1. Technical Field

The present invention relates to a liquid container and a liquid ejection apparatus.

2. Related Art

Inkjet printers (hereinafter also simply referred to as "printers") that discharge ink onto a sheet of printing paper to form an image are known as one mode of liquid ejection apparatuses. Printers are usually provided with an ink tank that stores ink to be supplied to a printing head. The printing head is one aspect of a liquid ejection head, and the ink tank is one aspect of a liquid container. Ink tanks are usually provided with an air introduction part so that outside air is introduced into the ink tank along with the consumption of ink. Also, some ink tanks are provided with an ink injection part so that a user can add ink from the outside (e.g. CN-A-104015492).

An ink tank provided with such an air introduction part and an ink injection part is sometimes transported together with a printer, in the state of storing ink and remaining attached to the printer. When the printer is transported in such a manner, the ink tank is positioned in an orientation that is different from a normal orientation during the usage of the printer, for example, and in some cases, the ink inside the ink tank leaks from the air introduction part. Also, in other cases, the printer might be transported to a place in which the temperature and the altitude are significantly higher than those at which the printer is expected to be used, and the air in the ink tank expands and the ink inside the ink tank leaks by being pushed out to the air introduction part or the ink injection part due to the difference in the air pressure between the inside and the outside of the ink tank. In this way, techniques for preventing ink from leaking from an ink tank still have room for improvements.

SUMMARY

An advantage of some aspects of the invention is to solve at least some of the above-described problems, which are present not only in an ink tank and a printer but also in a liquid container that stores liquid and a liquid ejection apparatus provided with the liquid container. The invention can be realized in the following aspects.

[1] A first aspect of the invention provides a liquid container. This liquid container includes: a liquid container part: a liquid injection part; an air introduction part; and a buffer part. The liquid container part may be able to store the liquid. The liquid injection part, through which the liquid may be injected to the liquid container part from an outside. The air introduction part, through which outside air may be introduced to the liquid container part, from an outside. The buffer part may be in communication with the liquid container part via a first communication path, and in communication with the air introduction part via a second communication path. When the liquid container is in a first orientation in which the liquid is supplied to the liquid ejection head at the time the liquid is to be ejected, a first opening end of the first communication path may be located in an area in the liquid container part where air is present when the liquid occupies half the capacity of the liquid container part, the first opening end being an opening end of the liquid container part. The buffer part, when the liquid container is in a second orientation that is rotated from the first orientation by 180°, may be configured to store the liquid having a volume that is equal to or larger than a volume of the liquid in the liquid container part such that a surface of the liquid is located below a second opening end and a third opening end, the second opening end being an opening end of the first communication path in the buffer part, and the third opening end being an opening end of the second communication path in the buffer part. With the liquid container according to this aspect, when the liquid container is in the second orientation, the liquid flown out of the liquid container part via the first communication path can be retained in the buffer part. Also, in such a state, air can be distributed to the inside of the liquid container via the air introduction part. Therefore, the liquid in the liquid container is prevented from being pushed out to the outside due to the expansion of air in the ink container part.

[2] In the liquid container according to the above-described aspect, when the liquid container is in the first orientation, the first opening end of the first communication path may be provided in an upper end portion located at an upper end of the liquid container part, and when the liquid container is in the first orientation and in the second orientation, the second opening end may be located in a lower end portion that is located at a lower end of the buffer part. With the liquid container according to this aspect, it is possible to downsize the buffer part, and to prevent the liquid from leaking from the liquid container via the air introduction part.

[3] In the liquid container according to the above-described aspect, when the liquid container is in the first orientation, the buffer part may be located above the liquid container part. With the liquid container according to this aspect, when the liquid container is in the first orientation, the liquid is prevented from flowing from the liquid container part into the buffer part. Also, with the liquid container according to this aspect, when the liquid container is in the first orientation, the liquid that has flown into the buffer part is likely to return to the liquid container part.

[4] In the liquid container according to the above-described aspect, when the liquid container is in the first orientation, the buffer part may be located below the liquid container part. With the liquid container according to this aspect, when the liquid container is in the second orientation, the liquid in the liquid container part is prevented from flowing into the buffer part, and the liquid is prevented from leaking from the air introduction part.

[5] In the liquid container according to the above-described aspect, when the liquid container is in the first orientation, the buffer part may be located in a direction that vertically intersects the liquid container part. With the liquid container according to this aspect, when the liquid container is in the first orientation, the liquid in the liquid container part is prevented from flowing into the buffer part. Also, the liquid container is prevented from being large in the upward direction and the downward direction in the first orientation.

[6] In the liquid container according to the above-described aspect, the air introduction part may have an air intake part that is open outward, and when the liquid container is in the first orientation, the air intake part may be located at the same level as or above the first opening end in the liquid container part. With the liquid container according to this aspect, the liquid is prevented from leaking from the air intake part when the liquid container is in various orientations.

[7] In the liquid container according to the above-described aspect, the buffer part may include a plurality of divided buffer parts that are in communication with each other, and when the liquid container is in the second orientation, a total volume of the liquid that is configured to be retained in the plurality of divided buffer parts may be equal to or larger than the capacity of the liquid container part. With the liquid container part according to this aspect, the liquid is prevented by the divided buffer parts from reaching the air introduction part.

[8] In the liquid container according to the above-described aspect, the liquid container part and the buffer part may be located adjacent to each other with a partition interposed between the liquid container part and the buffer part. With the liquid container according to this aspect, the liquid container part and the buffer part are provided close to each other, and therefore it is possible to downsize the liquid container and simplify the configuration of the liquid container.

[9] In the liquid container according to the above-described aspect, when the liquid container is in the first orientation, the buffer part may be located above the liquid container part with the partition interposed between the buffer part and the liquid container part, and when the liquid container is in the first orientation, the partition may include a bottom surface that is a lower end surface of the buffer part and a top surface that is an upper end surface of the liquid container part, and the buffer part may be communicated with the liquid container part through the first communication path on the partition. With the liquid container according to this aspect, it is possible to shorten the first communication path, and it is easy to downsize the liquid container and simplify the configuration of the liquid container.

[10] In the liquid container according to the above-described aspect, the air introduction part and the buffer part are located adjacent to each other with a partition wall interposed between the air introduction part and the buffer part. With the liquid container according to this aspect, the air introduction part and the buffer part are provided close to each other, and therefore it is possible to downsize the liquid container and simplify the configuration of the liquid container.

[11] In the liquid container according to the above-described aspect, when the liquid container is in the first orientation, the partition wall may extend in a vertical direction, and the air introduction part may be communicated with the buffer part through the second communication path on an end portion of the partition wall. With the liquid container according to this aspect, it is possible to form the second communication path with a simple configuration, and it is easy to downsize the liquid container and simplify the configuration of the liquid container.

[12] In the liquid container according to the above-described aspect, the liquid container part may be provided with a recessed portion that is separated from the first opening end of the liquid container part, and that is open upward when the liquid container is in the second orientation. With the liquid container according to this aspect, when the orientation is switched from the first orientation to the second orientation, a portion of the liquid stored in the liquid container part can be retained in the recessed part. Therefore, the amount of liquid stored in the liquid container part after the orientation of the liquid container has been changed back to the first orientation is prevented from decreasing from before the orientation has been changed to the second orientation.

[13] A second aspect of the invention provides a liquid ejection apparatus. The liquid ejection apparatus according to this aspect includes: a liquid container, a liquid ejection head; and an outer casing. The liquid container may be a liquid container according to any one of the above-described aspects. The liquid ejection head may be supplied with the liquid from the liquid container. The outer casing may house the liquid container and the liquid ejection head. The liquid container may include a visual check part that visually checks a liquid surface level of the liquid stored in the liquid container part, and the outer casing may be included with a window located at a position that directly faces the visual check part. With the liquid ejection apparatus according to this aspect, the liquid is prevented from leaking from the liquid container. Also, since the user can visually check the shortage of the liquid in the liquid container, the user convenience is improved.

[14] In the liquid ejection apparatus according to the above-described aspect, the visual check part may include an upper limit indicator configured to indicate a guide of an upper limit position of the liquid surface when the liquid container is in the first orientation, and when the liquid container is in the first orientation, the air introduction part may be located above the upper limit indicator. With the liquid ejection apparatus according to this aspect, the liquid is further prevented from leaking from the liquid container.

[15] In the liquid ejection apparatus according to the above-described aspect, a portion of an outer wall that is included in the outer casing may be included with a lid member that is attached to a position that faces the liquid container housed in the outer casing, such that the lid member is openable and closeable, and the window may be provided in the lid member. With the liquid ejection apparatus according to this aspect, the accessibility for the user to the liquid container is improved, and therefore the user convenience is further improved.

The constituent elements included according to the above-described aspects of the invention are not all essential, and in order to solve some or all of the above-described problems or achieve some or all of the advantageous effects described in this specification, some of the constituent elements can be modified, omitted, and replaced with other constituent elements as necessary, and the limiting content can be partially omitted. Also, in order to solve some or all of the above-described problems or achieve some or all of the above-described advantageous effects, some or all of the technical features in any of the above-described aspects of the invention can be combined with some or all of the technical features included in another one of the above-described aspects of the invention so as to obtain an independent aspect of the invention.

The invention may be realized in various modes other than the liquid container or the liquid ejection apparatus. For example, the invention may be realized as a liquid container unit or a liquid supply apparatus provided with the liquid container, a liquid ejection system, a flow channel structure for a liquid and air in the liquid container, a structure in which the liquid container part and the air introduction part are arranged in the liquid ejection apparatus, and so on.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Configuration of Inkjet Printer

Figure 1:
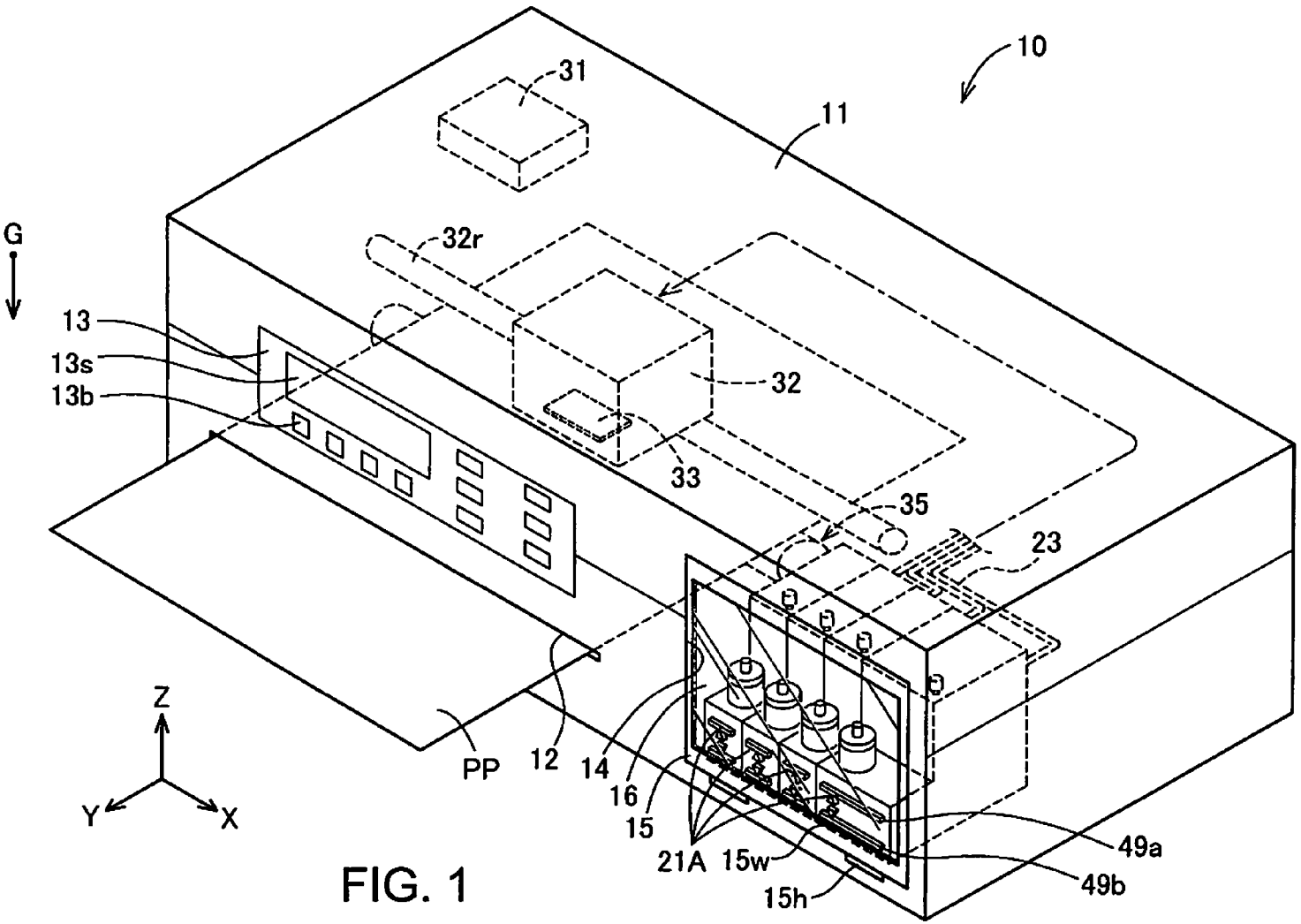
FIG. 1 is a schematic perspective view showing a configuration of an inkjet printer according to a first embodiment.

The following describes a configuration of an inkjet printer 10 (hereinafter simply referred to as the "printer 10") according to a first embodiment of the invention with reference to FIGS. 1 and 2. FIG. 1 is a schematic perspective view showing the configuration of the printer 10. FIG. 1 shows the printer 10 in an expected normal usage state (hereinafter simply referred to as "the normal orientation"). In the present embodiment, the normal orientation is an orientation in which the main scanning direction and the sub scanning direction of the printer 10 are parallel with a horizontal plane that is orthogonal to the direction of gravity (vertical direction). The main scanning direction of the printer 10 is the direction in which a printing head 33 moves back and forth during the execution of printing. The sub scanning direction is orthogonal to the main scanning direction, and is the direction in which a sheet of printing paper PP is conveyed at a position where ink is discharged from the printing head 33 during the execution of printing.

FIG. 1 shows arrows X, Y, and Z that indicate three directions that are orthogonal to each other, and an arrow G that indicates the direction of gravity. The arrow X indicates a direction that is parallel with the main scanning direction and, that is a left-to-right direction when the user directly faces the front surface of the printer 10. In this description, "the front surface of the printer 10" is the surface that is expected to be directly faced by the user when the user is operating the printer 10 in the normal orientation. The arrow Y indicates the direction that is parallel with the sub scanning direction, and indicates a direction from the rear surface side to the front surface side of the printer 10. The arrow Z indicates the direction that is parallel with the direction of gravity when the printer 10 is in the normal orientation, and that is a bottom-to-top direction. In the following description, "upward" and "downward" indicate the upward direction and the downward direction with reference to the direction of gravity when the printer 10 is in the normal orientation. Also, "left" and "right" indicate the left direction and the right direction when the user directly faces the printer 10 in the normal orientation. The arrows X, Y, Z, and G are shown in the drawings that are referred to in the following description, as appropriate.

The printer 10 is an embodiment of the liquid ejection apparatus according to the invention, and performs printing processing, which is processing to discharge ink droplets onto the sheet of printing paper PP, which is a printing medium, to form an image. The printer 10 includes a casing 11, a plurality of ink tanks 21A, a plurality of tubes 23, and a printing part 30. The casing 11 is a hollow box made of resin and formed by injection forming, and houses the ink tanks 21A, the tubes 23, and the printing part 30, which are mentioned above. The casing 11 is a specific concept of an outer casing of the liquid ejection apparatus according to the invention.

The surface of the casing 11 that constitutes the front surface of the printer 10 is provided with a paper discharge port 12, an interface part 13, and an opening/closing lid 15. The paper discharge port 12 is an opening for discharging a sheet of printing paper PP from the inside of the printer 10. The interface part 13 is a part having an operation button 13*b* for receiving a user operation, and a display 13*s* for providing the user with information regarding the printer 10. The opening/closing lid 15 constitutes a part of a wall of the casing 11, and is an openable/closeable door part that allows access to the ink tanks 21A inside. The opening/closing lid 15 is attached to an opening part 14 of the casing 11, provided on the front side of the ink tanks 21A, with hinge mechanisms 15*h* between them.

Figure 2:
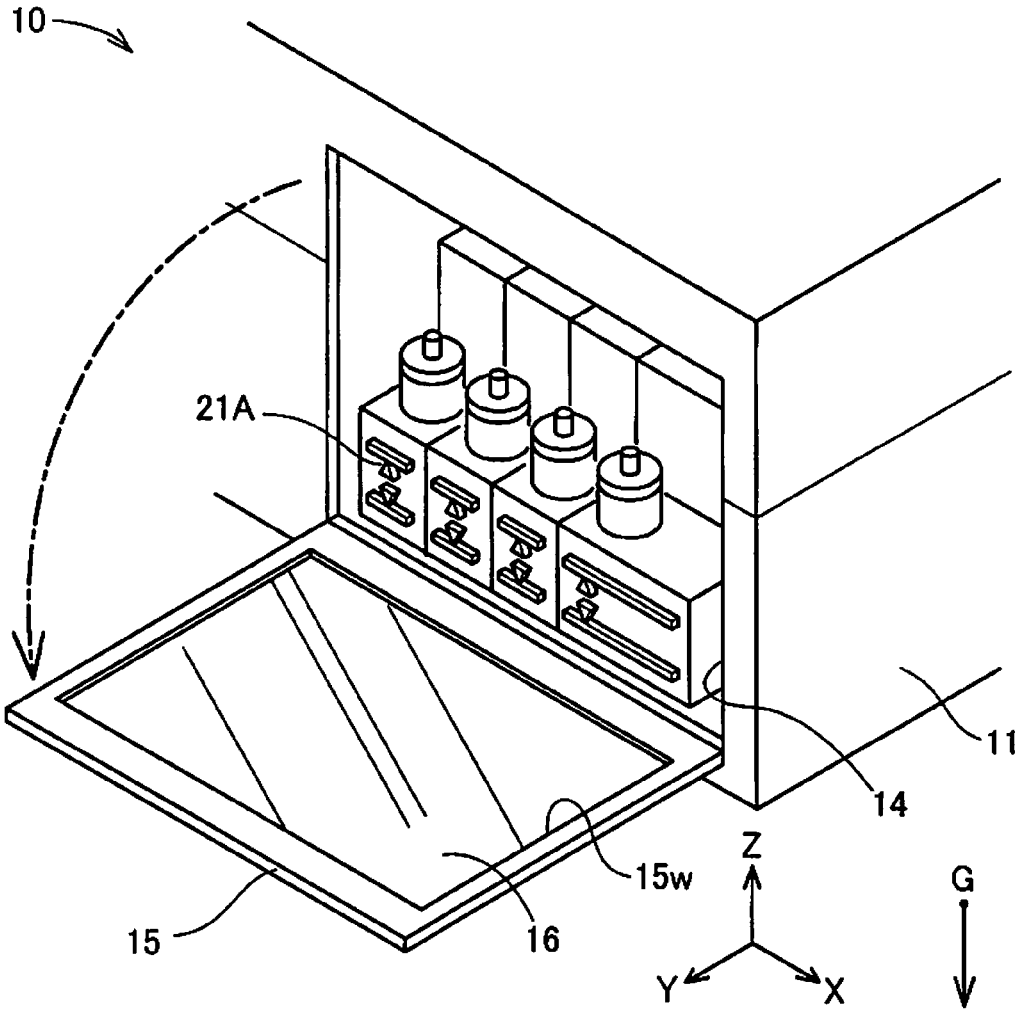
FIG. 2 is a schematic perspective view showing an opening/closing lid of the inkjet printer according to the first embodiment.

FIG. 2 is a schematic perspective view showing a state in which the opening/closing lid 15 of the printer 10 is open. The opening/closing lid 15 opens and closes by rotating about the hinge mechanisms 15*h* (FIG. 1) provided on the lower end of the front surface of the printer 10. When the opening/closing lid 15 is open, the user can add ink to the plurality of ink tanks 21A fixed within the casing 11. The opening/closing lid 15 is provided with a window 15*w* that allows the user to visually check the ink tanks 21A from the outside when the opening/closing lid 15 is closed. A resin plate 16 that is transparent is attached to the window 15*w*. The user can visually check the amount of ink remaining in the ink tanks 21A through the window 15*w* even when the opening/closing lid 15 is in the closed state. In this way, with the printer 10 according to the present embodiment, the user convenience and the ease of maintenance of the printer 10 are improved due to the presence of the opening/closing lid 15.

The plurality of ink tanks 21A (FIG. 1) are hollow containers that store ink to be supplied to the printing part 30, and each store ink of a different color. Ink is a specific concept of a liquid according to the invention, and each of the ink tanks 21A is an embodiment of a liquid container according to the invention. According to the present embodiment, four ink tanks 21A respectively corresponding to the colors cyan, magenta, yellow, and black are arranged in the stated order along the direction indicated by the arrow X at positions that directly face the opening/closing lid 15. The ink tank 21A for black ink, which is consumed by a larger amount than ink of the other colors, is configured to have a large width in the direction indicated by the arrow X so that a larger amount of ink can be stored therein compared to the ink tanks 21A for the other colors. The ink tank 21A for black ink has approximately the same configuration as the ink tanks 21A for ink of the other colors, except that the capacity is different as described above. Therefore, in the following description, the ink tank 21A for black ink is not particularly distinguished from the ink tanks 21A for ink of the other colors. The configurations of the ink tanks 21A will be described later.

The tubes 23 are pipe members that are made of resin and are flexible. The tubes 23 are respectively connected to the ink tanks 21A. Ink in the ink tanks 21A is supplied to the printing head 33 of the printing part 30 via the tubes 23.

The printing part 30 includes a controller 31, a carriage 32, and a paper conveyance mechanism 35 in addition to the printing head 33. The controller 31 is constituted by, for example, a microcomputer including a central processing unit and a main memory, and achieves various functions by the central processing unit reading various programs to the main memory and executing the programs. In the printer 10, printing processing and various kinds of maintenance processing are performed under the control of the controller 31.

The carriage 32 is installed so as to be able to move back and forth along the main scanning direction on the conveyance path of the printing paper PP. The carriage 32 moves back and forth along a rail 32*r* that is installed on the conveyance path of sheets of printing paper PP, by receiving drive force from a motor (not shown) transmitted by a pulley (not shown). An ink retainer (not shown) that temporarily retains ink is arranged above the carriage 32, along the main scanning direction, and the printing head 33 is attached below the carriage 32.

Ink in the ink tanks 21A is supplied to the above-described ink retainer via the tubes 23, and is supplied from the ink retainer to an ink chamber of the printing head 33. Note that a pump (not shown or described in detail) for sucking ink from the ink tanks 21A is provided upstream of the ink retainer. Nozzles for discharging ink of the respective colors are provided on the lower surface of the printing head 33, and the printing head 33 discharges ink droplets from the nozzles onto the printing surface of a sheet of printing paper PP that is being conveyed, using a well-known method such as applying pressure to ink using a piezoelectric element. The printing head 33 is a specific concept of a liquid ejection head according to the invention.

The paper conveyance mechanism 35 is capable of conveying sheets of printing paper PP along the sub scanning direction, using the rotational driving of a conveyance roller. During the execution of printing, the controller 31 causes the paper conveyance mechanism 35 to convey a sheet of printing paper PP to the paper discharge port 12 at a predetermined conveyance speed. Then, the controller 31 causes the printing head 33 to move back and forth along the main scanning direction, and to discharge ink droplets from the nozzles of the printing head 33 onto the sheet of printing paper PP at timing determined based on print data.

Configuration of Ink Tank

Figure 3:
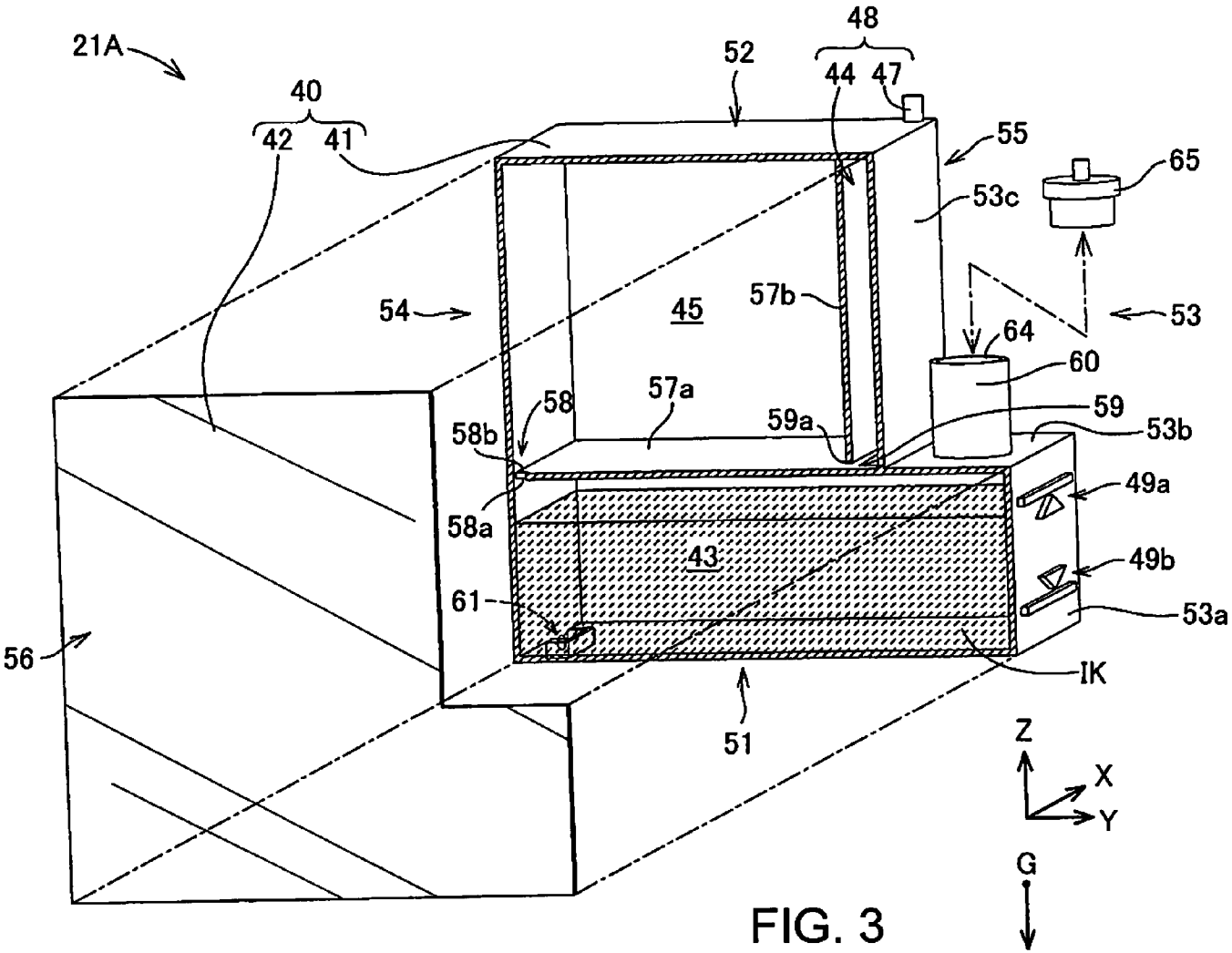
FIG. 3 is a schematic exploded perspective view showing an ink tank according to the first embodiment in a first orientation.

FIG. 3 is a schematic exploded perspective view of the ink tank 21A seen from the right side surface. FIG. 3 schematically shows that ink IK is stored in an ink container part 43 described below. The arrows X, Y, and Z shown in FIG. 3 correspond to directions in the situation where the ink tank 21A is fixed to the printer 10. In the following, a description is given of the ink tank 21A in a reference orientation, which is the orientation when the ink tank 21A is fixed to the printer 10 in the normal orientation. In the following description, this orientation is also referred to as "the first orientation". In the present embodiment, the first orientation is the orientation of the ink tank 21A at the time of supplying ink to the printing head 33 that discharges ink droplets during the execution of printing, and is also the orientation of the ink tank 21A when the user injects ink into the ink tank 21A. In the following, a schematic configuration of a main body 40 of the ink tank 21A is described, and then the ink container part 43, an air introduction part 48 including an air flow channel 44, a buffer part 45, an ink injection part 60, and an ink supply part 61, which are provided in the ink tank 21A are described.

Schematic Configuration of Ink Tank Main Body

The main body 40 of the ink tank 21A includes a casing member 41 and a sheet member 42 (FIG. 3). The casing member 41 is a hollow box made of resin, and the right side face, which is located in the direction opposite to the direction indicated by the arrow X, is entirely open. The casing member 41 is manufactured by integrally molding nylon or polypropylene, for example. The sheet member 42 is constituted by a flexible resin film member. The sheet member 42 is constituted by nylon or polypropylene, for example. The sheet member 42 is adhered to, and covers, the opening of the right side surface of the casing member 41. In FIG. 3, the area to which the sheet member 42 is attached is indicated by hatching with oblique lines.

The ink tank 21A has six walls 51 to 56 that respectively constitute six surfaces, namely a bottom surface, a top surface, a front surface, a rear surface, a right side surface, and a left side surface. Note that in the present specification, "walls" are not limited to be those extending along a flat surface, and may be curved or have bent portion or a step portion, and may have a recessed portion, protruding portion, a groove, or an inclined surface on the surface. In the present specification if something "extends", it seamlessly extends in a certain direction. If something "extends", it may extend in a certain direction and be bent or curved in the middle. Also, in the following description, if two walls "intersect" each other, the two walls may actually be intersect each other, or one wall is present in the direction toward which the other wall extends, or the directions along which the two walls respectively extend intersect. Therefore, a chamfered portion or the like that constitutes a curved surface may be interposed between two walls intersecting each other.

The first wall 51 is constituted by one outer wall of the casing member 41, and extends in two directions indicated by the arrows X and Y. When the ink tank 21A is in the first orientation, the first wall 51 is arranged along a horizontal plane and constitutes the bottom surface of the ink tank 21A.

The second wall 52 is constituted by an outer wall of the casing member 41, and extends in two directions indicated by the arrows X and Y at a position that faces the first wall 51. When the ink tank 21A is in the first orientation, the second wall 52 is located above the first wall 51, and constitutes the top surface of the ink tank 21A. In the present specification, to "face" means that the subjects directly face each other, or the subjects indirectly face each other with another thing interposed therebetween.

A third wall 53 is constituted by an outer wall of the casing member 41, constitutes a wall that extends in two directions indicated by the arrows X and Z, and intersects the first wall 51 and the second wall 52. The third wall 53 constitutes the front surface of the ink tank 21A that is located on the front side of the printer 10. In the present embodiment, the third wall 53 includes three portions 53*a*, 53*b*, and 53*c*. The first portion 53*a* is located further on the front side of the third portion 53*c*. The second portion 53*b* extends in the direction that is opposite the direction indicated by the arrow Y between the first portion 53*a* and the third portion 53*c*, and constitutes a step portion.

A fourth wall 54 is constituted by an outer wall of the casing member 41, extends in two directions indicated by the arrows X and Z, and intersects the first wall 51 and the second wall 52. The fourth wall 54 is located on the rear surface side that is opposite the front surface side of the printer 10, and constitutes the rear surface of the ink tank 21A. A fifth wall 55 is constituted by an outer wall of the casing member 41, extends in two directions indicated by the arrows Y and Z, and intersects the first wall 51, the second wall 52, the third wall 53, and the fourth wall 54. The fifth wall 55 constitutes the right side surface of the ink tank 21A.

A sixth wall 56 is consisted by the sheet member 42, extends in two directions indicated by the arrows Y and Z, and intersects the first wall 51, the second wall 52, the third wall 53, and the fourth wall 54 at a position that faces the fifth wall 55. The fifth wall 55 constitutes the left side surface of the ink tank 21A.

A first inner wall 57*a* that extends in two directions indicated by the arrows X and Y, and a second inner wall 57*b* that extends in two directions indicated by the arrows X and Z are provided inside the casing member 41. In the present embodiment, the first inner wall 57*a* is formed so as to extend in the direction that is opposite to the direction indicated by the arrow Y and span from an end of the second portion 53*b* of the third wall 53 to the fourth wall 54.

The second inner wall 57*b* is located at a position that is between the third portion 53*c* of the third wall 53 and the fourth wall 54 and is on the front side, and extends from the second wall 52 to a position before the first inner wall 57*a* in the direction opposite to the direction indicated by the arrow Z. The distance between the second inner wall 57*b* and the third portion 53*c* of the third wall 53 may be several millimeters. Also, the distance between the lower end of the second inner wall 57*b* and the first inner wall 57*a* may be within the range of approximately 0.5 mm to several millimeters. The end surfaces of the two inner walls 57*a* and 57*b* on the right side are adhered to the sheet member 42.

Three inner spaces 43, 44, and 45 that are separated by the above-described two inner walls 57*a* and 57*b*, and that each have an approximately cuboid shape, are formed inside the casing member 41. The first inner space 43 is located in an area below the first inner wall 57*a*. The second and the third inner space 44 and 45 are located in areas above the first inner wall 57*a* and are arranged along the direction indicated by the arrow Y. The second inner space 44 is located on the front side of the second inner wall 57*b*, and the third inner space 45 is located on the rear surface side of the second inner wall 57*b*.

Ink Container

In the ink tank 21A, ink IK is stored in the first inner space 43. In the following, the portion where the first inner space 43 is formed is also referred to as "the ink container part 43". The ink container part 43 is a specific concept of a liquid container according to the invention. In the present embodiment, the first wall 51 constitutes the bottom surface of the ink container part 43, and the first inner wall 57*a* and the second portion 53*b* of the third wall 53 constitute the top surface of the ink container part 43. Also, the first portion 53*a* of the third wall 53 constitutes the front surface of the ink container part 43, and the lower area of the fourth wall 54 constitutes the rear surface of the ink container part 43.

Here, in the present embodiment, at least the first portion 53*a* of the third wall 53 out of the five walls 51 to 55 that constitute the casing member 41 has a portion that is transparent or semi-transparent so as to allow the user to visually check the liquid surface of the ink stored in the ink container part 43. In the ink tank 21A, the first portion 53*a* of the third wall 53 functions as a visual check part that allows the user to check the liquid surface of ink.

Two marks 49*a* and 49*b* are provided on the first portion 53*a* of the third wall 53 as protrusions on the wall surface. The first mark part 49*a* indicates a predetermined upper limit position of the liquid surface of ink in the ink container part 43 when the ink tank 21A is in the first orientation. The first mark part 49*a* is a specific concept of an upper limit indicator of the invention. The second mark part 49*b* indicates a predetermined lower limit position of the liquid surface of ink in the ink container part 43 when the ink tank 21A is in the first orientation. The two marks 49*a* and 49*b* are provided at positions where the user who directly faces the printer 10 can visually check through the window 15*w* of the printer 10 (FIG. 1). Note that both or at least either one of the two marks 49*a* and 49*b* may be omitted. Also, the marks 49*a* and 49*b* may not be formed as protrusions on the wall surfaces, and may be formed as a seal or by printing onto the wall surface.

Air Introduction Part

In the ink tank 21A, an air intake part 47 that is cylindrical is provided on an end portion of the second wall 52 on the fifth wall 55 side above the second inner space 44. The second inner space 44 is in communication with the outside of the ink tank 21A via the cylindrical hole of the air intake part 47, and functions as a flow channel through which air taken from the outside of the ink tank 21A via the air intake part 47 flows. In the following, the second inner space 44 is also referred to as "the air flow channel 44". The air flow channel 44, together with the air intake part 47, functions as the air introduction part 48 for taking air into the ink container part 43.

In the ink tank 21A, the air introduction part 48 is located above the ink container part 43, and is located above the first mark part 49*a*. Therefore, the first mark part 49*a* alerts the user so that the user does not inject too much ink IK into the ink container part 43, and it is thus possible to prevent the user from adding ink IK to the extent that ink IK reaches the air introduction part 48. Therefore, ink IK is prevented from leaking due to ink IK being added too much.

Buffer Part

As described below, the third inner space 45 has the function of storing air taken by the ink container part 43, and the function of retaining ink IK overflown from the ink container part 43, and preventing ink IK from reaching the air flow channel 44. In the following, the third inner space 45 is also referred to as "the buffer part 45".

The buffer part 45 and the ink container part 43 are adjacent to each other in the direction indicated by the arrow Z with the first inner wall 57*a* interposed between them, and are in communication with each other via a first communication path 58 provided in the first inner wall 57*a*. In the present embodiment, the first communication path 58 is located in an end portion of the first inner wall 57*a* on the rear surface side, and is formed as a recess by cutting a corner on the end portion on the sheet member 42 in an approximately rectangular shape. The first inner wall 57*a* is a specific concept of a "partition" of the invention.

The buffer part 45 and the air flow channel 44 are adjacent to each other in the direction indicated by the arrow Y with the second inner wall 57*b* between them, and are in communication with each other via a gap 59 provided between the lower end of the second inner wall 57*b* and the first inner wall 57*a* described above. In the following, the gap 59 is also referred to as "the second communication path 59". The second inner wall 57*b* is a specific concept of a "partition wall" of the invention.

As described above, in the ink tank 21A, the ink container part 43 and the buffer part 45 are in communication with each other via the first communication path 58, and the buffer part 45 and the air flow channel 44 are in communication with each other via the second communication path 59. An opening end 58*a* of the first communication path 58 on the ink container part 43 side is a specific concept of a first opening end of the invention, and an opening end 58*b* on the buffer part 45 side is a specific concept of a second opening end of the invention. An opening end 59*a* of the second communication path 59 on the buffer part 45 side is a specific concept of a third opening end of the invention.

When the ink tank 21A is in the first orientation, usually, the buffer part 45 does not store ink IK, and stores air. While the printer 10 is executing printing, ink IK is supplied from the ink container part 43 of the ink tank 21A to the printing head 33 via the ink supply part 61 described below. Along with the consumption of the ink IK in the ink container part 43, air flows into the buffer part 45 from the air flow channel 44 via the second communication path 59, and air flows into the ink container part 43 from the buffer part 45 via the first communication path 58.

The opening end 58*a* of the first communication path 58 on the ink container part 43 side is, when the ink tank 21A is in the first orientation, located at the upper end portion of the ink container part 43. Therefore, when the ink tank 21A is in the first orientation and not a small amount of air as well as ink IK are stored in the ink container part 43, the opening end 58*a* is located in an area in the ink container part 43 where air is present. Therefore, when the ink tank 21A is in the first orientation, the opening end 58*a* is prevented from being closed by ink IK, and air can flow into the ink container part 43 via the first communication path 58.

The buffer part 45 is configured such that the capacity of the area above the opening end 59*a* of the second communication path 59 is approximately equal to or larger than the volume of the ink IK in the ink container part 43. In the present embodiment, "the volume of the ink IK in the ink container part 43" is the upper limit of the volume of ink IK that can be stored in the ink container part 43, and the volume of ink IK when the ink container part 43 is fully filled with ink IK and no air is remaining.

Thus, when the ink tank 21A is in the second orientation inverted upside down from the first orientation, for example, even if almost all the ink IK stored in the ink container part 43 flows into the buffer part 45, the buffer part 45 can retain the ink IK. Therefore, ink IK is prevented from leaking from the air introduction part 48. In addition, when the ink tank 21A is positioned in various orientations that are different from the first orientation, ink IK is prevented from leaking from the air introduction part 48 due to the presence of the channel structure between the air introduction part 48 and the ink container part 43 including the buffer part 45. The details of the mechanism in which the ink IK is prevented from leaking from the ink tank 21A will be described later.

As described above, in the ink tank 21A according to the present embodiment, the air flow channel 44 and the buffer part 45 are formed by partitioning the space inside the casing member 41 with two inner walls 57*a* and 57*b*. Also, the first communication path 58 and the second communication path 59 are configured as communication paths that penetrate in the thickness direction of the inner walls 57*a* and 57*b*. Therefore, the configuration of the ink tank 21A is simplified and the ink tank 21A is downsized, and it is easy to manufacture the ink tank 21A as well.

Ink Injection Part

The ink tank 21A is provided with the ink injection part 60. The ink injection part 60 is a part for receiving ink injected into the ink container part 43 from the outside. In the present embodiment, the ink injection part 60 is formed as a cylindrical part that protrudes above from the second portion 53*b* of the third wall 53, and has a through hole 64 that is in communication with the ink container part 43. The user of the printer 10 can add ink IK to the ink container part 43 of the ink tank 21A that is fixed in the first orientation to the printer 10 that is in the normal orientation, via the ink injection part 60. The ink injection part 60 is a specific concept of a liquid injection part according to the invention.

In the ink tank 21A in the present embodiment, the ink injection part 60 is provided on the front side of the ink tank 21A, and the accessibility for the user to the ink injection part 60 is improved. The third portion 53*c* of the third wall 53 is provided on the rear surface side of the ink injection part 60. Therefore, when ink IK is added via the ink injection part 60, the third portion 53*c* of the third wall 53 prevents the ink IK from being scattered to an area deep inside the printer 10.

A cap member 65 is fitted into the upper opening end of the through hole 64 of the ink injection part 60. The cap member 65 is detachably attached to the ink injection part 60. In the present embodiment, the cap member 65 is constituted by a flexible resin member, and is manufactured by integrally molding nylon or polypropylene, for example. Since the cap member 65 is flexible, the sealing properties of the cap member 65 to the ink injection part 60 is improved. Usually, when the printer 10 is transported or while the printer 10 is executing the printing, the cap member 65 is attached to the ink injection part 60 so as to seal the ink injection part 60 airtight. When the ink IK is injected into the ink container part 43 via the ink injection part 60, the cap member 65 is removed from the ink injection part 60.

Ink Supply Part

The ink supply part 61 is provided on the lower end portion of the ink tank 21A (shown in dotted lines in FIG. 3.). The ink supply part 61 is a connector that connects the ink container part 43 and the tube 23 (FIG. 1.). The ink IK stored in the ink container part 43 is supplied to the printing head 33 of the printing part 30 via the tube 23 of the ink supply part 61. In the present embodiment, the ink supply part 61 is provided in the end portion of the first wall 51 on the rear surface side. The ink supply part 61 is formed as a hollow part that protrudes downward from the ink container part 43. The ink supply part 61 is provided with a cylindrical pipe part to which the tube 23 is connected in the direction indicated by the arrow Y.

Mechanism of Ink Leakage Prevention

With reference to FIGS. 4 to 8 one by one, the following describes the mechanism in which the ink IK stored in the ink tank 21A in various orientations is prevented from leaking. FIGS. 4 to 8 respectively show schematic perspective views of the ink tank 21A in different orientations. In FIGS. 4 to 8, the sheet member 42, which is the sixth wall 56, and the tube 23 connected to the ink supply part 61 are omitted for the sake of convenience.

Figure 4:
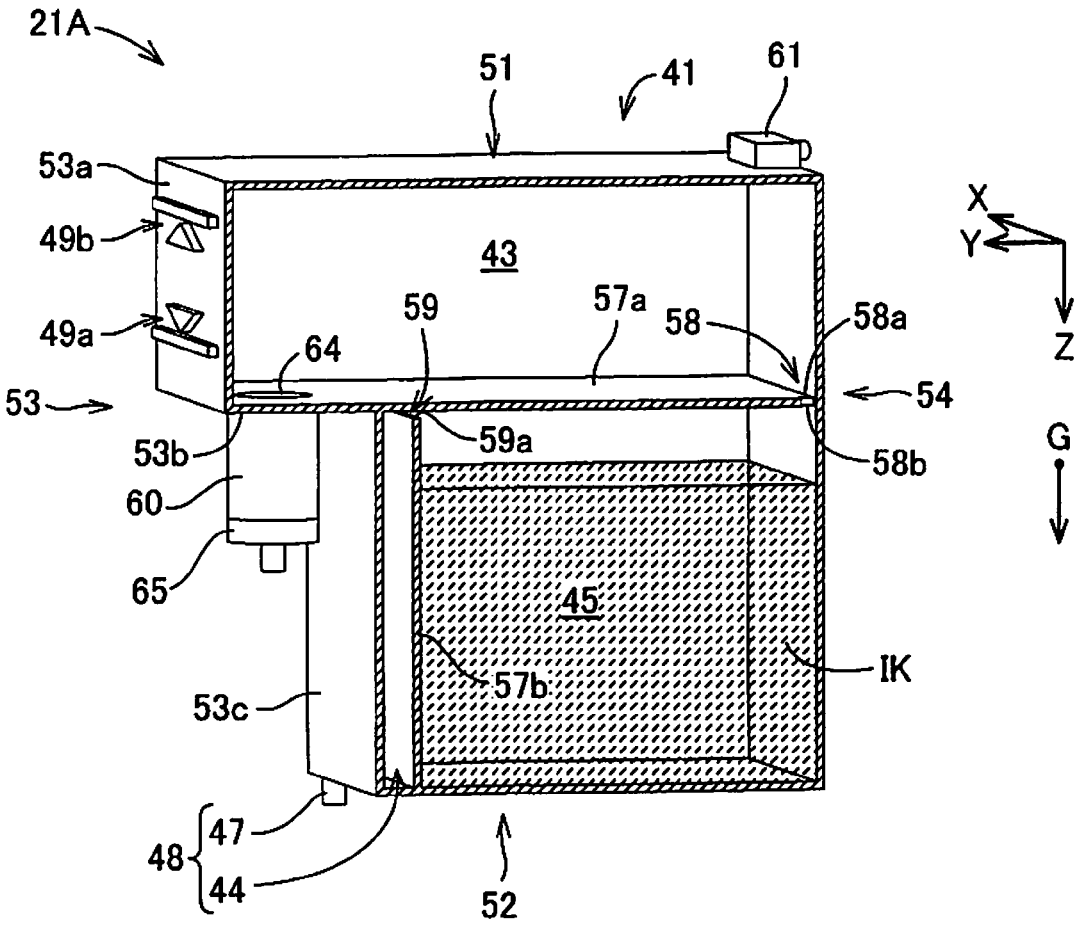
FIG. 4 is a schematic perspective view showing the ink tank according to the first embodiment in a second orientation.

FIG. 4 shows the ink tank 21A in a second orientation. The "second orientation" is the orientation of the ink tank 21A rotated upside down by 180° from the first orientation, and is the orientation in which the second wall 52 is arranged along a horizontal plane and the first wall 51 is located above the second wall 52. When the ink tank 21A is in the second orientation, the ink IK in the ink container part 43 gradually flows into the buffer part 45 via the first communication path 58.

Here, for example, if the printer 10 is transported from a place that satisfies the environmental conditions assumed at the time of factory shipment to a place in which the temperature is significantly high, or a place in which the altitude is high and the atmospheric pressure is low, there is the possibility of the air in the ink tank 21A expanding. If the printer 10 is transported to such an environment when the ink tank 21A is in the second orientation, and the air in the ink container part 43 expands, the ink IK in the ink container part 43 is pressed out to the buffer part 45 by the air.

With the ink tank 21A, almost all the amount of ink IK stored in the ink container part 43 can be retained in the area in the buffer part 45 below the opening end 59*a* of the second communication path 59. Therefore, when the ink tank 21A is in the second orientation, even if the ink IK flows out of the ink container part 43, almost all the amount of ink IK is retained in the buffer part 45. Therefore, ink IK is prevented from reaching the air flow channel 44 and leaking from the air intake part 47.

Also, in the ink tank 21A in the second orientation, the opening end 58*a* of the first communication path 58 on the buffer part 45 side is located at a position higher than the opening end 59*a* of the second communication path 59 on the buffer part 45 side. Therefore, when the ink tank 21A is in the second orientation, the opening end 58*a* of the first communication path 58 is prevented from being closed by the ink IK retained in the buffer part 45, and the ink container part 43 is prevented from being brought into a sealed state. Therefore, the cap member 65 and the tube 23 are prevented from becoming separated from the ink tank 21A due to the expansion of the air in the ink container part 43 and the increase of the pressure in the ink container part 43. Also, even if the tube 23 does not become separated, ink IK is prevented from leaking from the nozzles of the printing head 33 due to the ink IK in the tube 23 being pressed toward the printing head 33.

In addition, in the ink tank 21A, the ink container part 43 is located below the buffer part 45. Therefore, when the orientation is changed back to the first orientation from the second orientation, the ink IK that has flown into the buffer part 45 is likely to return to the ink container part 43 due to the effect of the gravity. In addition, in the ink tank 21A in the second orientation, the opening end 58*a* of the first communication path 58 and the opening end 59*a* of the second communication path 59, the buffer part 45 are located at the upper end portion of the buffer part 45. Therefore, it is not necessary to provide the buffer part 45 with a capacity larger than the capacity required for storing the ink IK in the ink container part 43. Therefore, the buffer part 45 is prevented from being larger than required, and the ink tank 21A is prevented from being large.

Figure 5:
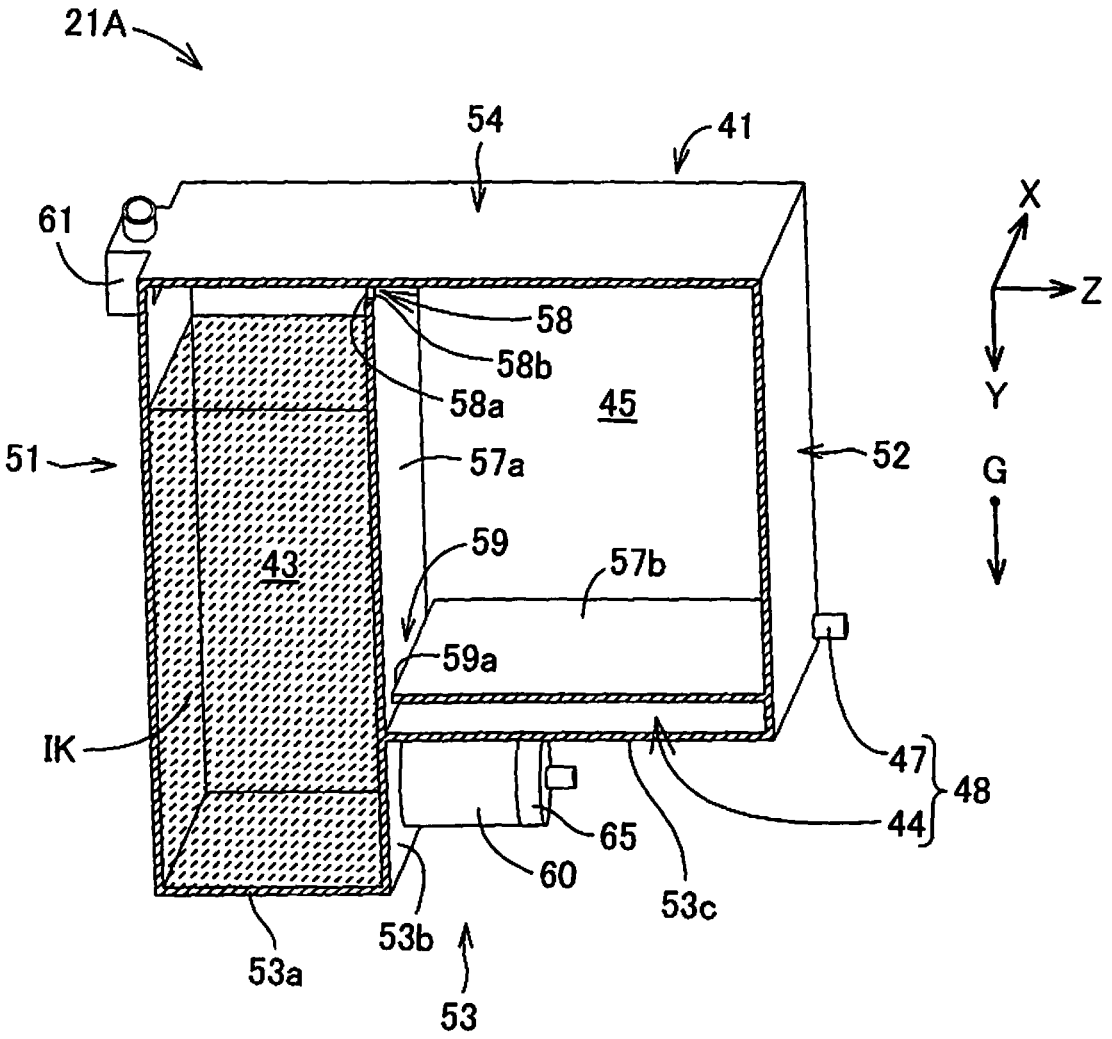
FIG. 5 is a schematic perspective view showing the ink tank according to the first embodiment in a third orientation.

FIG. 5 illustrates the state of the ink tank 21A in a third orientation. The "third orientation" is the orientation of the ink tank 21A rotated toward the front surface side by 90° from the first orientation, and is the orientation in which the third wall 53 entirely extends along a horizontal plane, and the fourth wall 54 is located above the third wall 53.

When the ink tank 21A is in the third orientation, the ink IK in the ink container part 43 is retained on the front side, and the opening end 58*a* of the first communication path 58 is located in the area where air is present. Therefore, in the same manner as in the case of the first orientation, a communication path for air to the ink container part 43 is formed with the buffer part 45 and the air introduction part 48. Therefore, as described above, even when the environment in which the printer 10 is disposed is changed such that the air in the ink tank 21A expands, the pressure in the ink tank 21A is prevented from increasing, and the leakage of the ink IK due to such an increase in the pressure is prevented.

Figure 6:
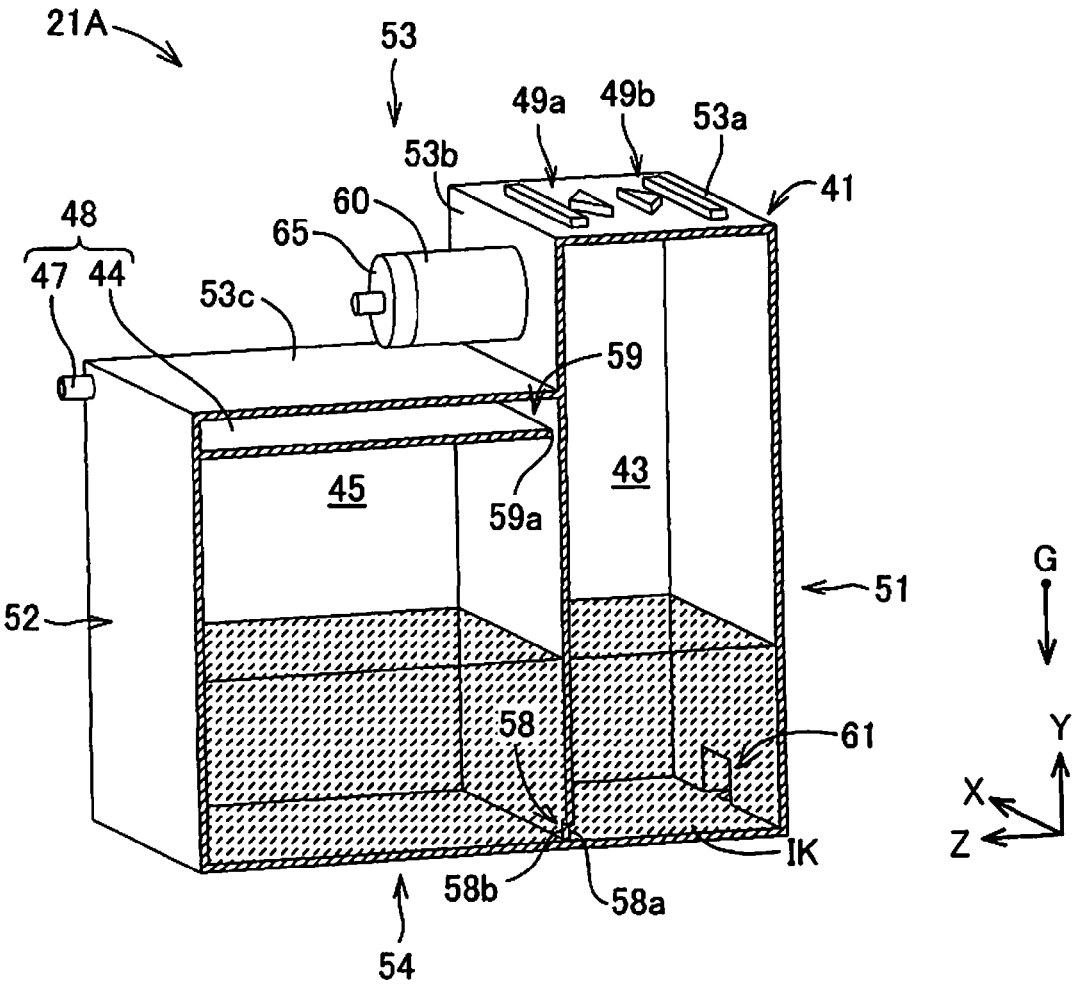
FIG. 6 is a schematic perspective view showing the ink tank according to the first embodiment in a fourth orientation.

FIG. 6 illustrates the state of the ink tank 21A in a fourth orientation. The "fourth orientation" is the orientation of the ink tank 21A rotated toward the rear surface side by 90° from the first orientation, and is the orientation in which the fourth wall 54 extends along a horizontal plane, and the third wall 53 is located above the fourth wall 54. When the ink tank 21A is in the fourth orientation, the ink IK in the ink container part 43 is retained in the area on the fourth wall 54 side. Also, a portion of the ink IK flows into the buffer part 45 via the first communication path 58, and is retained in the area of the buffer part 45 on the fourth wall 54 side. When the ink tank 21A is in the fourth orientation, the air flow channel 44 is located above the buffer part 45, and therefore the ink IK is prevented from leaking to the outside via the air flow channel 44.

In this state, when the environment in which the printer 10 is disposed is changed such that the air in the ink container part 43 expands as described above, there is the possibility of almost all the amount of ink IK in the ink container part 43 flowing into the buffer part 45 due to air. Even in such a case, with the ink tank 21A, the buffer part 45 has a capacity that is approximately the same or larger than the capacity of the ink container part 43, and can store almost all the amount of such ink IK. Therefore, ink IK is prevented from leaking from the buffer part 45 into the air flow channel 44 via the second communication path 59.

Figure 7:
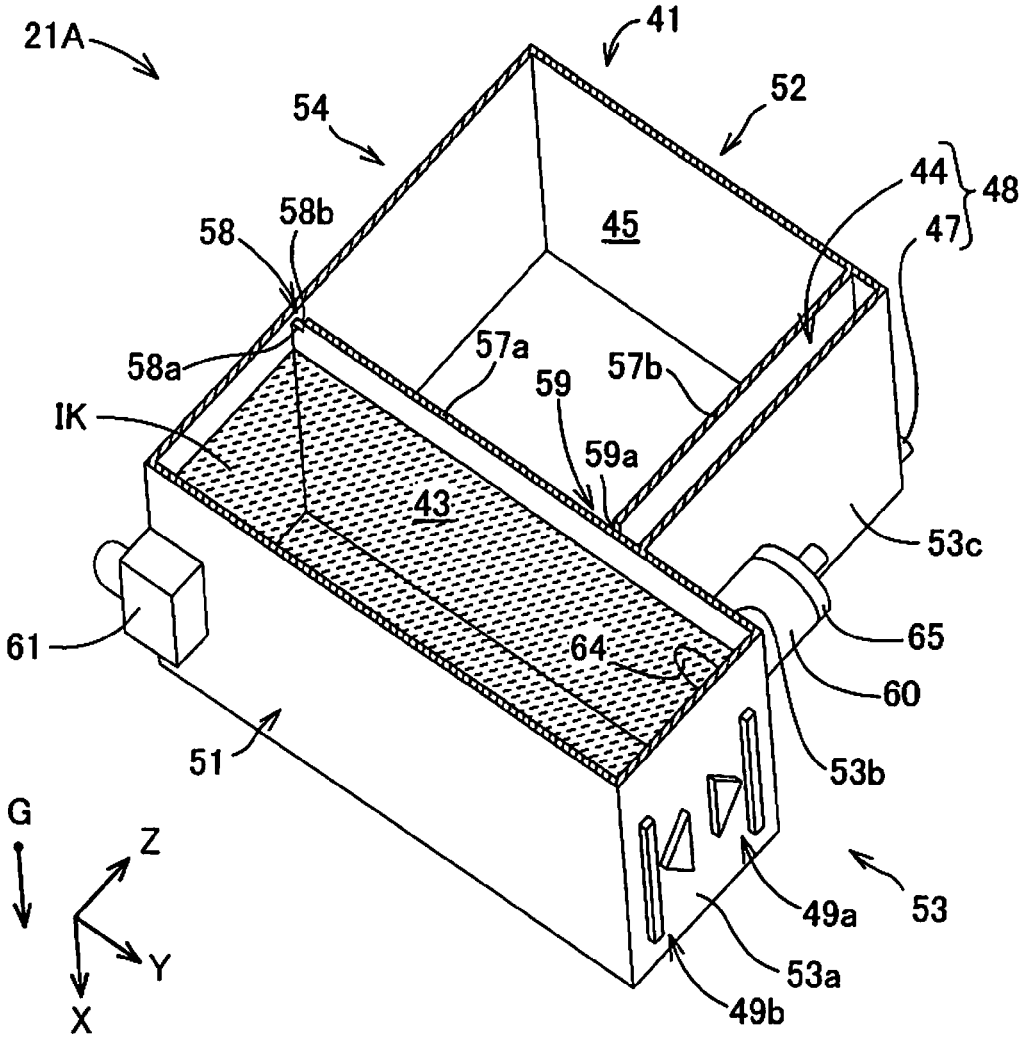
FIG. 7 is a schematic perspective view showing the ink tank according to the first embodiment in a fifth orientation.

FIG. 7 illustrates the state of the ink tank 21A in a fifth orientation. The "fifth orientation" is the orientation of the ink tank 21A rotated toward the right side surface side by 90° from the first orientation, and is the orientation in which the fifth wall 55 that constitutes the right side surface extends along a horizontal plane, and the sixth wall 56 is located above the fifth wall 55. When the ink tank 21A is in the fifth orientation, the ink IK in the ink container part 43 is retained in the fifth wall 55 side, and the opening end 58*a* of the first communication path 58 provided on an end portion on the fifth wall 55 side is located in an area where air is present. Therefore, ink IK is prevented from flowing from the ink container part 43 into the buffer part 45.

Also, when the ink tank 21A is in the fifth orientation, a communication path for air to the ink container part 43 is formed with the air introduction part 48 and the buffer part 45. Therefore, as described above, even when the environment in which the printer 10 is disposed is changed such that the air in the ink container part 43 expands, the pressure in the ink tank 21A is prevented from being increased by the expansion of the air within the ink container part 43, and the leakage of the ink IK due to such an increase in the pressure is prevented.

Figure 8:
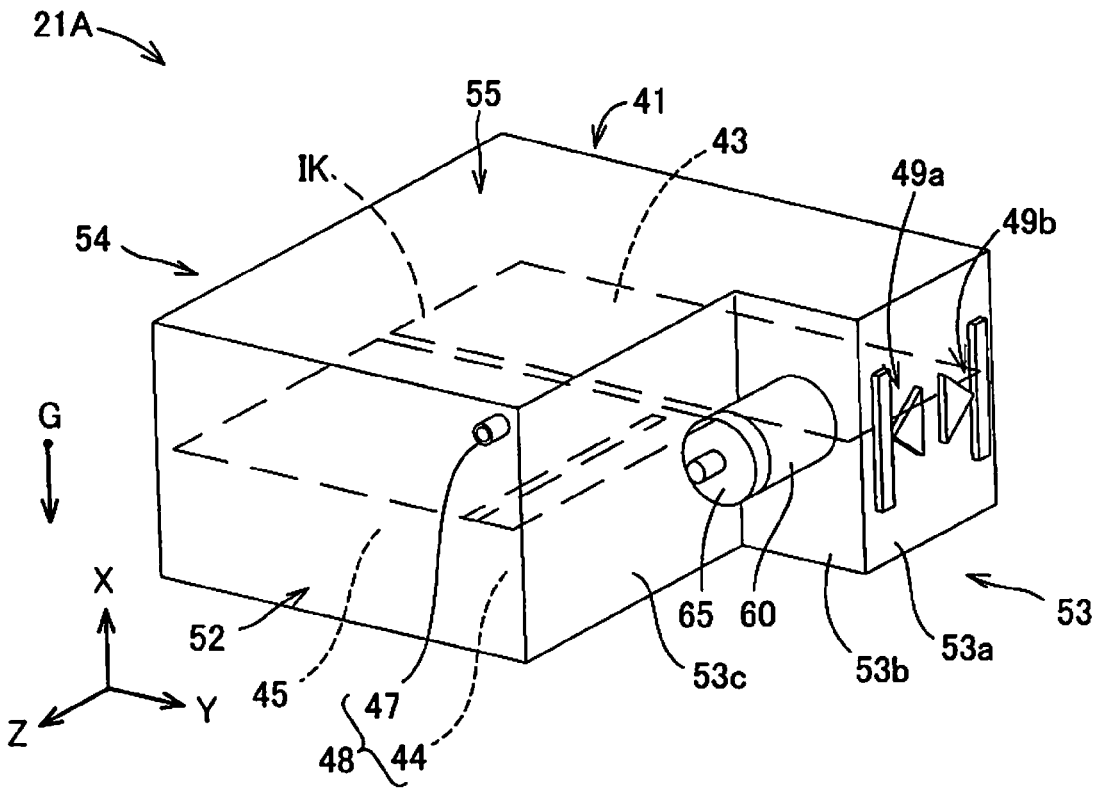
FIG. 8 is a schematic perspective view showing the ink tank according to the first embodiment in a sixth orientation.

FIG. 8 illustrates the state of the ink tank 21A in a sixth orientation. In FIG. 8, the positions of the liquid surface of ink IK in the ink container part 43 and the air flow channel 44 are shown as dotted lines. The "sixth orientation" is the orientation of the ink tank 21A rotated toward the left side surface side by 90° from the first orientation, and is the orientation in which the sixth wall 56 that constitutes the left side surface extends along a horizontal plane, and the fifth wall 55 is located above the sixth wall 56. When the ink tank 21A is in the sixth orientation, the ink IK in the ink container part 43 flows into the buffer part 45 via the first communication path 58, and flows into the air flow channel 44 via the second communication path 59. In the ink tank 21A, the air intake part 47 is provided in an end portion on the fifth wall 55 side, and when the ink tank 21A is in the sixth orientation, the air intake part 47 is located in an area of the air flow channel 44 where air is present. Therefore, ink IK is prevented from leaking via the air intake part 47.

Also, when the ink tank 21A is in the sixth orientation and the environment in which the printer 10 is disposed is changed such that the air in the ink container part 43 expands, ink IK is further pushed out to the buffer part 45 and to the air flow channel 44 from the ink container part 43. In this way, ink IK in the ink container part 43 can escape to the buffer part 45, and the pressure in the ink container part 43 is prevented from increasing. Also, since the buffer part 45 has a sufficient capacity as described above, ink IK is prevented from reaching the air intake part 47 and leaking to the outside.

Summary of First Embodiment

As described above, with the ink tank 21A according to the present embodiment, even when almost all the amount of ink IK has flown to the ink container part 43, almost all the amount of ink IK stored in the ink container part 43 can be stored in the buffer part 45. Also, with the ink tank 21A according to the present embodiment, when the ink tank 21A is in various orientations, the ink IK is prevented from reaching the air intake part 47 of the air introduction part 48. In addition, even when the environment in which the printer 10 is disposed is changed such that the air in the ink tank 21A expands, the pressure in the ink tank 21A is prevented from increasing. Therefore, in the printer 10, ink IK is prevented from leaking despite the intention. In addition, with the ink tank 21A according to the first embodiment and the printer 10 provided with the same, various functions and effects described in the first embodiment can be achieved.

B. Second Embodiment

Figure 9:
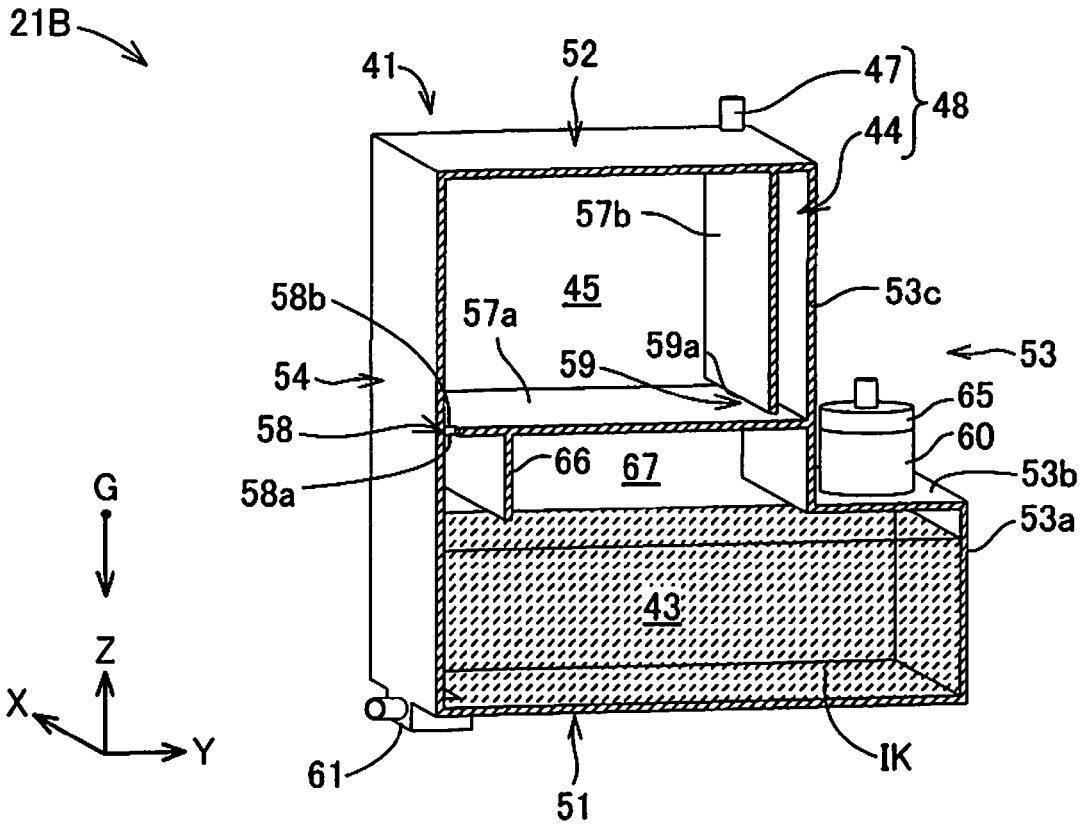
FIG. 9 is a schematic perspective view showing an ink tank according to a second embodiment in the first orientation.
Figure 10:
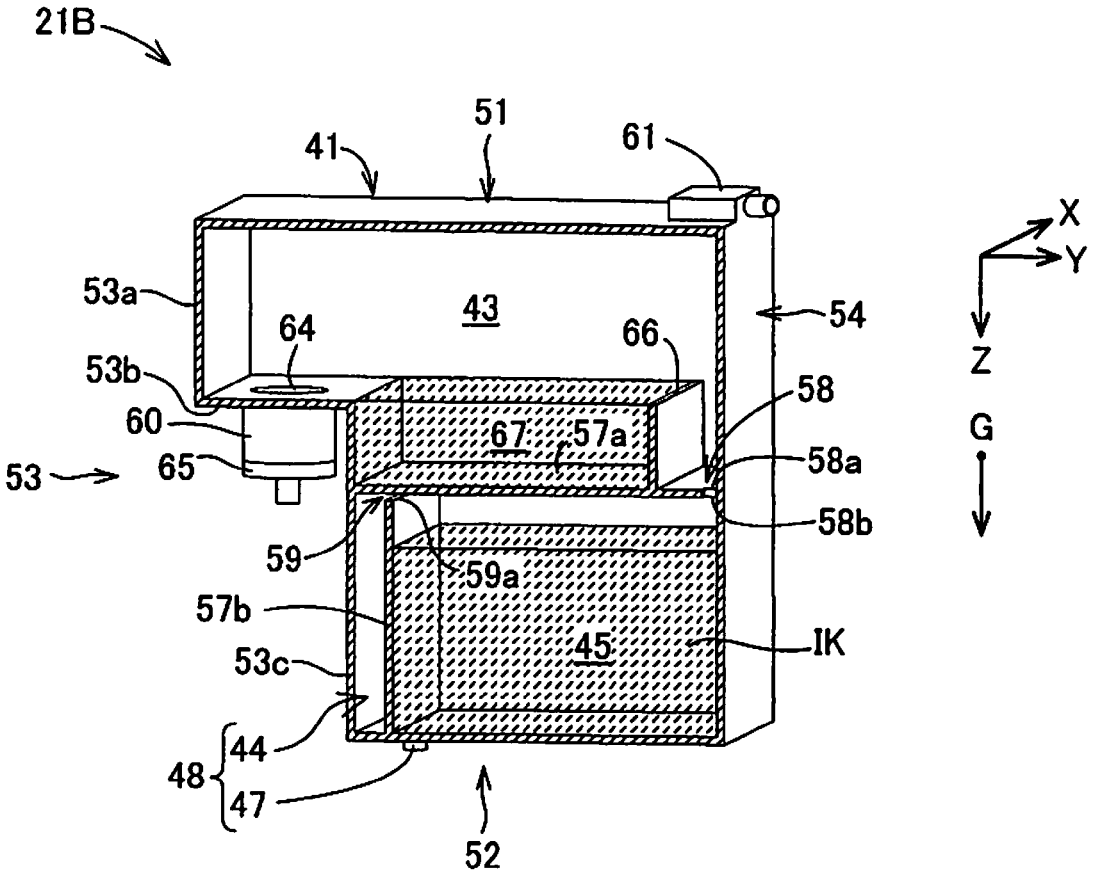
FIG. 10 is a schematic perspective view showing the ink tank according to the second embodiment in the second orientation.

The following describes a configuration of an ink tank 21B according to a second embodiment of the invention with reference to FIGS. 9 and 10. FIG. 9 is a schematic perspective view showing the ink tank 21B according to the second embodiment in the first orientation seen from the left side surface side. FIG. 10 is a schematic perspective view showing the ink tank 21B according to the second embodiment in the second orientation seen from the left side surface side. In FIGS. 9 and 10, the sheet member 42 is omitted. The ink tank 21B according to the second embodiment is installed to a printer that has the same configuration as the printer 10 described in the first embodiment (FIGS. 1 and 2), in the same orientation as the orientation of the ink tank 21A according to the first embodiment.

The ink tank 21B according to the second embodiment has almost the same configuration as the ink tank 21A according to the first embodiment, except that the ink container part 43 is provided with a dangling wall 66, which is an inner wall of the casing member 41. The dangling wall 66 extends downward from the first inner wall 57*a* to almost the same level as the level to which the second portion 53*b* of the third wall 53 extends. The dangling wall 66 is formed along the entire length of the ink container part 43 in the direction indicated by the arrow X. The right side end portion of the dangling wall 66 is connected to the fifth wall 55, and the left side end portion is adhered to the sheet member 42, which is omitted from the drawing.

In the ink tank 21B, a recessed portion 67 that is surrounded by the dangling wall 66, the first inner wall 57*a*, the third portion 53*c* of the third wall 53, the fifth wall 55, and the sixth wall 56 constituted by the sheet member 42 is formed in an area above the ink container part 43. The recessed portion 67 opens downward. The recessed portion 67 is located at a position separated from the opening end 58*a* of the first communication path 58.

When the ink tank 21B is brought into the second orientation, a portion of the ink IK that flows into the recessed portion 67 when the ink tank 21B is brought into the second orientation does not flow into the buffer part 45 and is retained in the recessed portion 67, and the remaining portion of ink IK flows into the buffer part 45 and is retained (FIG. 10). In this way, with the ink tank 21B according to the second embodiment, the amount of ink IK flowing into the buffer part 45 when the ink tank 21B is in the second orientation is reduced by the amount of ink IK retained in the recessed portion 67. Therefore, ink IK is further prevented from leaking. Also, when the orientation is changed back to the first orientation from the second orientation, the state of ink IK stored in the ink container part 43 can be immediately recovered to the state before the orientation was changed to the second orientation, due to the ink IK retained in the recessed portion 67. In addition, with the ink tank 21B, the capacity of the buffer part 45 can be reduced by the amount of ink IK retained in the recessed portion 67, and thus the ink tank 21B can be downsized. In addition, with the ink tank 21B according to the second embodiment and the printer provided with the same, various functions and effects that are similar to those described in the first embodiment can be achieved.

C. Third Embodiment

Figure 11:
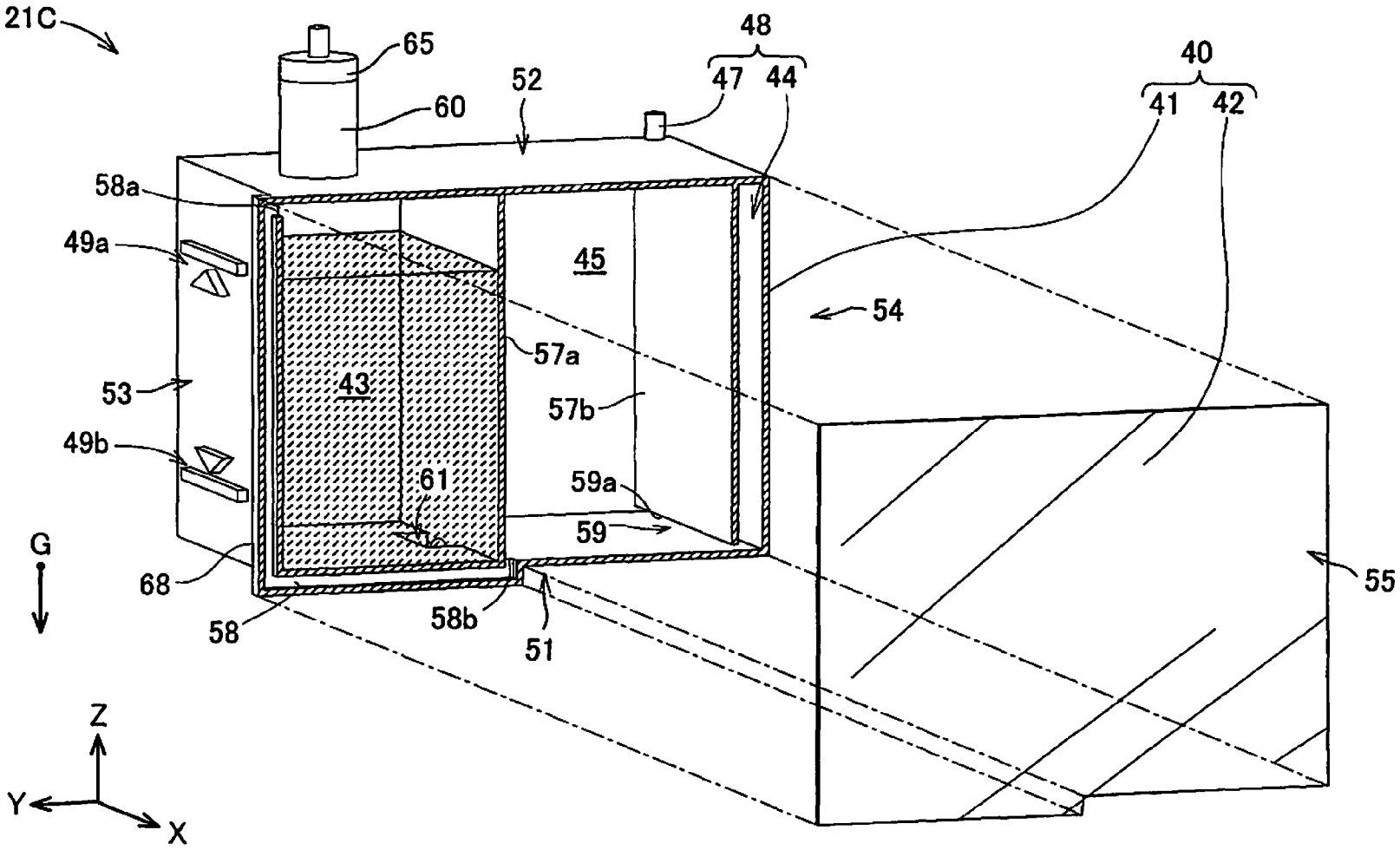
FIG. 11 is a schematic exploded perspective view showing an ink tank according to a third embodiment in the first orientation.

The following describes a configuration of an ink tank 21C according to a third embodiment of the invention with reference to FIGS. 11 to 16 one by one. In FIGS. 11 to 16, the tube 23, which is connected to the ink supply part 61, is omitted for the sake of convenience. In FIGS. 12 to 16, the sheet member 42 is omitted for the sake of convenience. FIG. 11 is a schematic perspective view showing the ink tank 21C according to the third embodiment in the first orientation seen from the right side surface side. FIG. 11 schematically shows the state in which the sheet member 42 has been removed.

The ink tank 21C according to the third embodiment has the same configuration as the ink tank 21A according to the first embodiment, except for the points described below. The ink tank 21C according to the third embodiment is installed to a printer that has the same configuration as the printer 10 described in the first embodiment (FIGS. 1 and 2), in the same orientation as the orientation of the ink tank 21A according to the first embodiment. In the ink tank 21C according to the third embodiment, the right side surface side of the casing member 41 is open, and the sheet member 42 constitutes the fifth wall 55. Also, in the ink tank 21C according to the third embodiment, as described below, the position of the buffer part 45 is different, and accordingly the configurations of the first communication path 58 and so on have been changed.

The ink tank 21C has an approximately cuboid shape, and when the ink tank 21C is in the first orientation, the buffer part 45 and the air introduction part 48 are arranged in the stated order on the rear surface side of the ink container part 43, along the direction opposite to the direction indicated by the arrow Y. The buffer part 45 and the air flow channel 44 have approximately the same width (height) in the direction indicated by the arrow Z as the ink container part 43. The third wall 53 of the ink tank 21C extends in the two directions indicated by the arrows X and Z along a flat surface, and does not have any equivalents to the second portion 53*b* and the third portion 53*c* described in the first embodiment. The third wall 53 of the ink tank 21C functions as a visual check part as described in the first embodiment, and has the two marks 49*a* and 49*b*.

In the ink tank 21C, the first inner wall 57*a* extends along the entire length in the direction indicated by the arrow X and the direction indicated by the arrow Z within the casing member 41 such that the first inner wall 57*a* separates the ink container part 43 and the buffer part 45 from each other. The ink supply part 61 is provided below the first inner wall 57*a*. The second inner wall 57*b* is provided between the buffer part 45 and the air flow channel 44 in the same manner as in the first embodiment. The buffer part 45 and the air flow channel 44 are in communication with each other via the second communication path 59 that is a gap formed at the lower end of the second inner wall 57*b*. The air intake part 47 is located at a corner that is at the end portion of the second wall 52 on the rear surface side and the end portion on the sixth wall 56 side.

In the ink tank 21C, the first communication path 58 is provided in a protruding portion 68 that protrudes outward from the opening end of the casing member 41. The protruding portion 68 protrudes toward the front surface side from the third wall 53 along the entire length in the direction indicated by the arrow Z, and protrudes downward from an area of the first wall 51 below the ink container part 43. The sheet member 42 is adhered to the surface of the protruding portion 68 on the fifth wall 55 side. The first communication path 58 is constituted by a flow channel groove provided in the right side surface of the protruding portion 68.

The first communication path 58 is connected to the upper end of the ink container part 43 at the end portion on the fifth wall 55 side, extends from the upper end to the lower end of the ink container part 43, extends to the rear surface side, and is then connected to the end portion of the buffer part 45 on the first inner wall 57*a* side. In the ink tank 21C, the opening end 58*a* of the first communication path 58 on the ink container part 43 side is located at a corner at the upper end of the ink container part 43 on the fifth wall 55 side. The opening end 58*b* of the first communication path 58 on the buffer part 45 side is located at a corner at the lower end of the buffer part 45 on the fifth wall 55 side.

Figure 12:
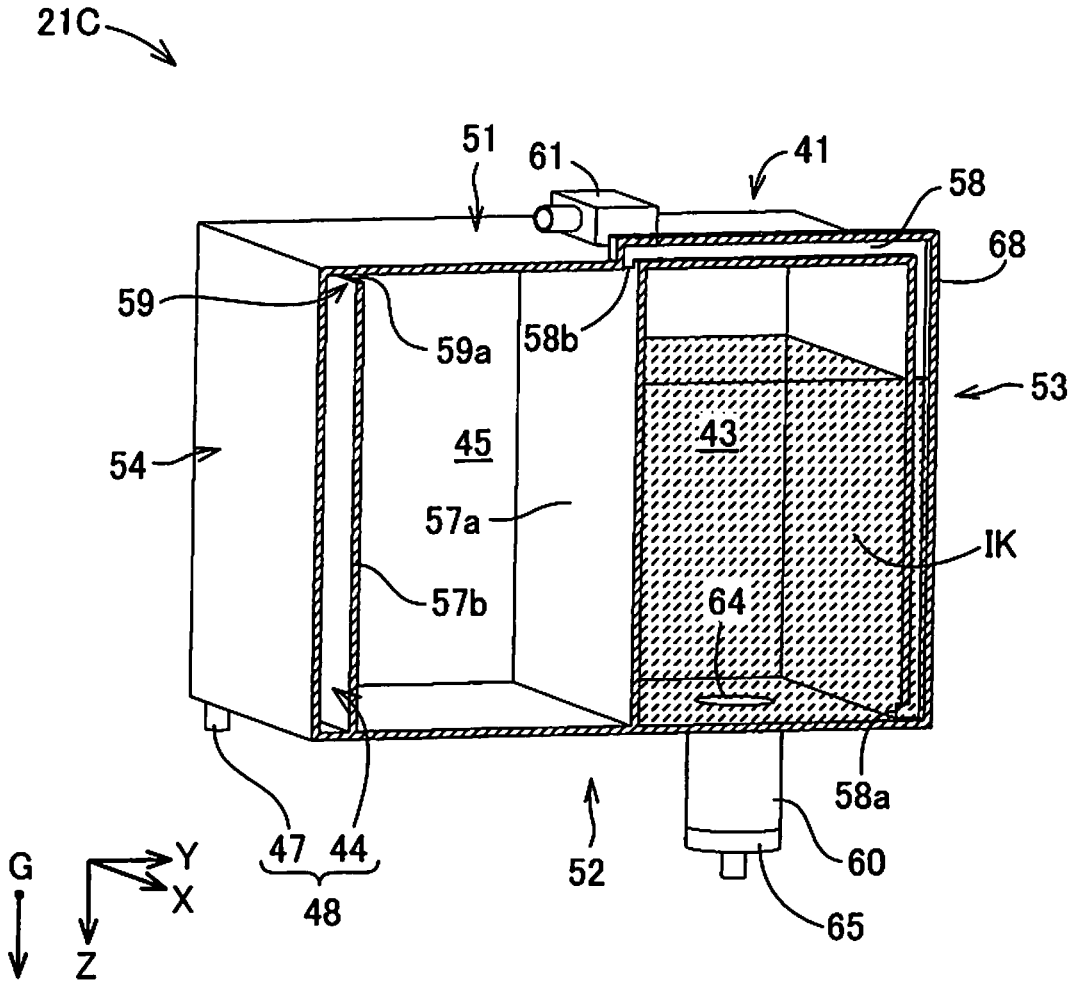
FIG. 12 is a schematic perspective view showing the ink tank according to the third embodiment in the second orientation.

FIG. 12 illustrates the state of the ink tank 21C in the second orientation. When the ink tank 21C is in the second orientation, the ink IK in the ink container part 43 flows into the first communication path 58, but is unlikely to reach the buffer part 45 because the first communication path 58 extends to a position at the upper end of the ink container part 43. Also, even when the environment in which the printer 10 is disposed is changed and the ink IK in the ink container part 43 is pushed out to the first communication path 58 due to the expansion of air, almost all the amount of ink IK can be retained in the buffer part 45. Therefore, the ink IK is prevented from flowing into the air flow channel 44, and from leaking to the outside of the ink tank 21C via the air introduction part 48.

Figure 13:
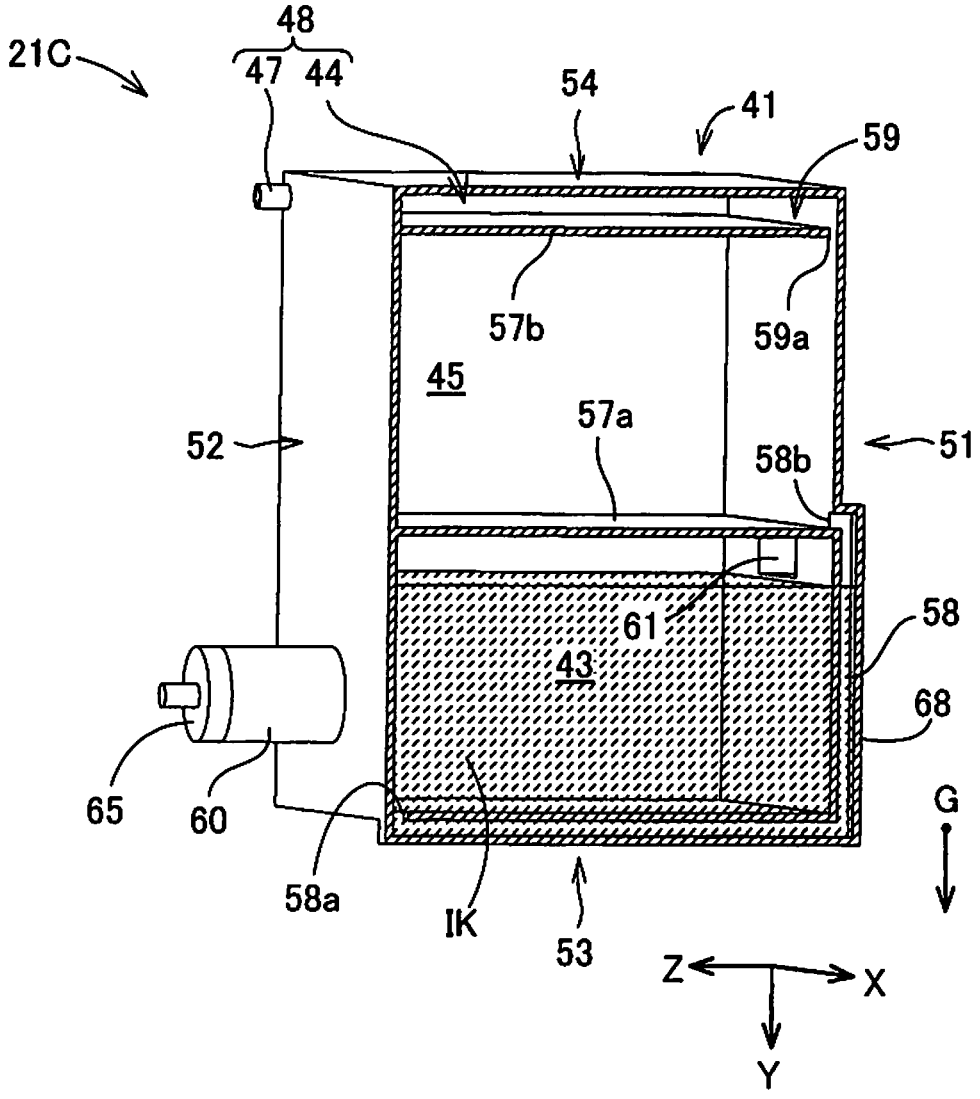
FIG. 13 is a schematic perspective view showing the ink tank according to the third embodiment in the third orientation.

FIG. 13 illustrates the state of the ink tank 21C in the third orientation. When the ink tank 21C is in the third orientation, in the same manner as in the case of the second orientation, the first communication path 58 extends to a position at the upper end of the ink container part 43. Therefore, the ink IK that has flown into the first communication path 58 from the ink container part 43 is unlikely to reach the buffer part 45. Also, even when the environment in which the printer 10 is disposed is changed and the ink IK in the ink container part 43 is pushed out to the first communication path 58 due to the expansion of air, in the same manner as in the case of the second orientation, the ink IK is retained in the buffer part 45 and is prevented from flowing into the air flow channel 44. Therefore, ink IK is prevented from leaking to the outside of the ink tank 21C via the air introduction part 48.

Figure 14:
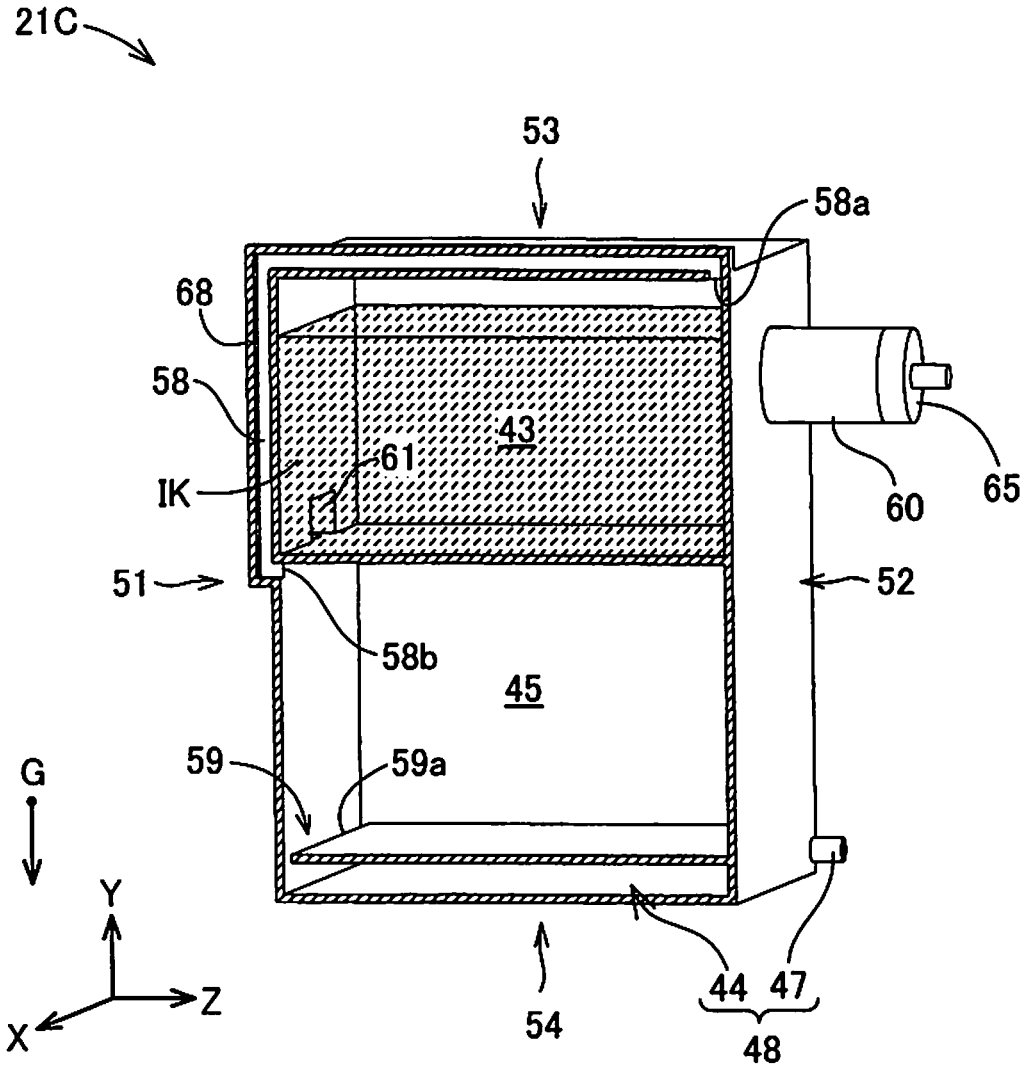
FIG. 14 is a schematic perspective view showing the ink tank according to the third embodiment in the fourth orientation.

FIG. 14 illustrates the state of the ink tank 21C in the fourth orientation. When the ink tank 21C is in the fourth orientation, the opening end 58*a* of the first communication path 58 is located in an area in the ink container part 43 where air is present. Therefore, the ink IK in the ink container part 43 is unlikely to flow into the first communication path 58, and is prevented from reaching the buffer part 45 and the air introduction part 48. Also, even when the environment in which the printer 10 is disposed is changed and the air in the ink container part 43 expands, the air can flow to the outside, and the pressure in the ink tank 21C is prevented from increasing.

Figure 15:
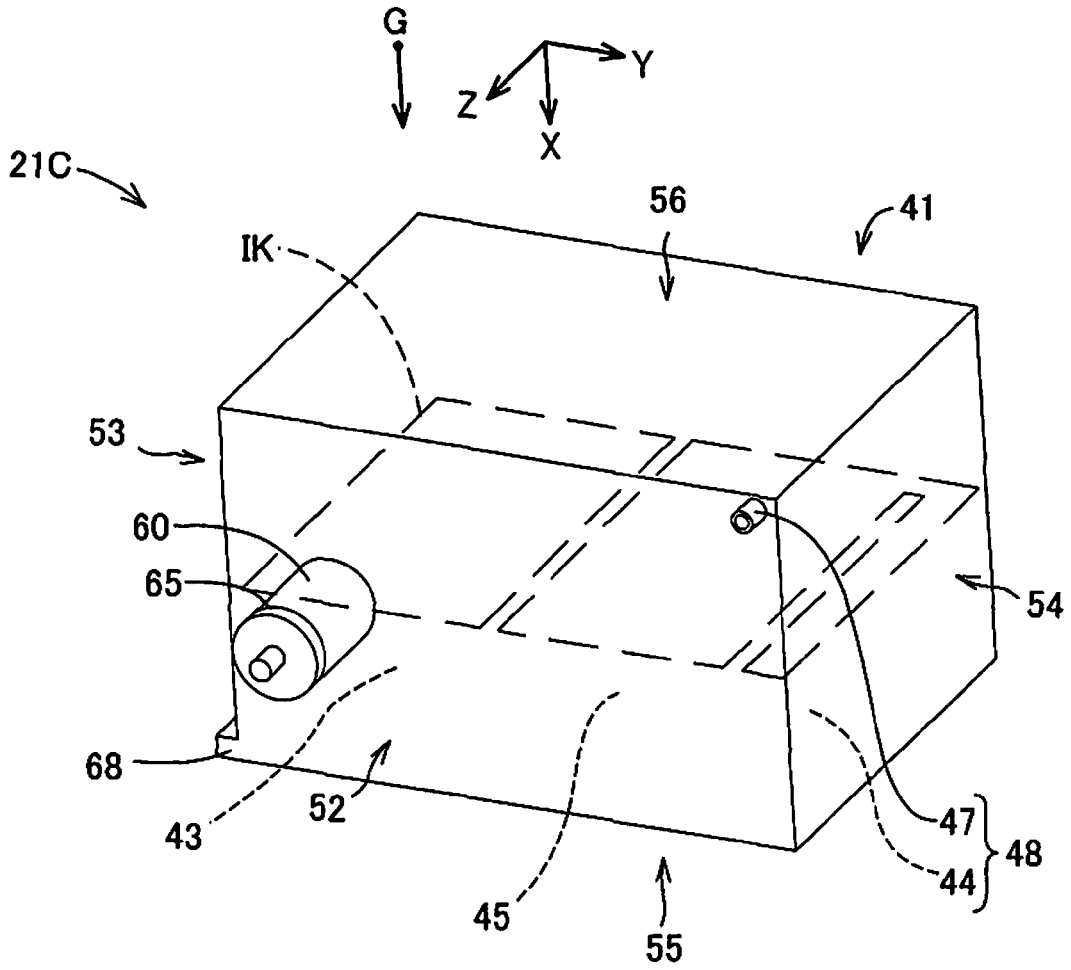
FIG. 15 is a schematic perspective view showing the ink tank according to the third embodiment in the fifth orientation.

FIG. 15 illustrates the state of the ink tank 21C in the fifth orientation. When the ink tank 21C is in the fifth orientation, the ink IK in the ink container part 43 flows into the buffer part 45 via the first communication path 58, and flows into the air flow channel 44 via the second communication path 59. In the ink tank 21C, the air intake part 47 is provided in an end portion on the sixth wall 56 side, and when the ink tank 21C is in the fifth orientation, the air intake part 47 is located in an area of the air flow channel 44 where air is present. Therefore, ink IK is prevented from leaking via the air intake part 47. Also, even when the environment in which the printer 10 is disposed is changed and air in the ink container part 43 expands, almost all the amount of ink IK pushed out of the ink container part 43 can be retained in the buffer part 45 and the air flow channel 44. Therefore, ink IK is prevented from reaching the air intake part 47, and ink IK is prevented from leaking via the air intake part 47.

Figure 16:
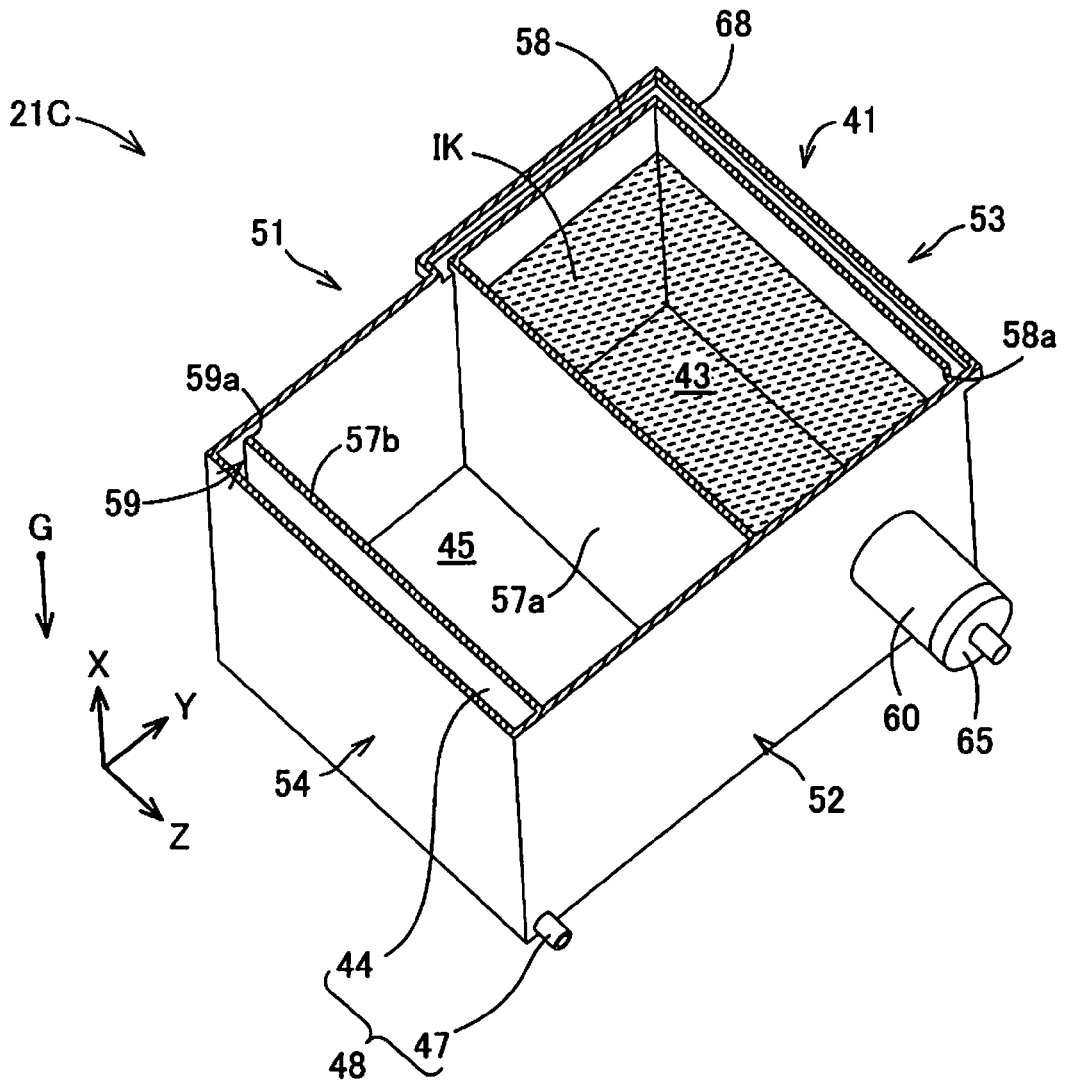
FIG. 16 is a schematic perspective view showing the ink tank according to the third embodiment in the sixth orientation.

FIG. 16 illustrates the state of the ink tank 21C in the sixth orientation. When the ink tank 21C is in the sixth orientation, the opening end 58*a* of the first communication path 58 is located in an area in the ink container part 43 where air is present. Therefore, the ink IK in the ink container part 43 is unlikely to flow into the first communication path 58. Also, even when the environment in which the printer 10 is disposed is changed and air in the ink container part 43 expands, the air can flow to the outside via the first communication path 58, and the pressure in the ink container part 43 is prevented from increasing.

As described above, with the ink tank 21C according to the third embodiment, as with the ink tank 21A according to the first embodiment, the ink IK is prevented from leaking from the ink tank 21C in various orientations. In addition, with the ink tank 21C according to the third embodiment and the printer provided with the same, various functions and effects that are similar to those described in the first embodiment can be achieved.

D. Fourth Embodiment

Figure 17:
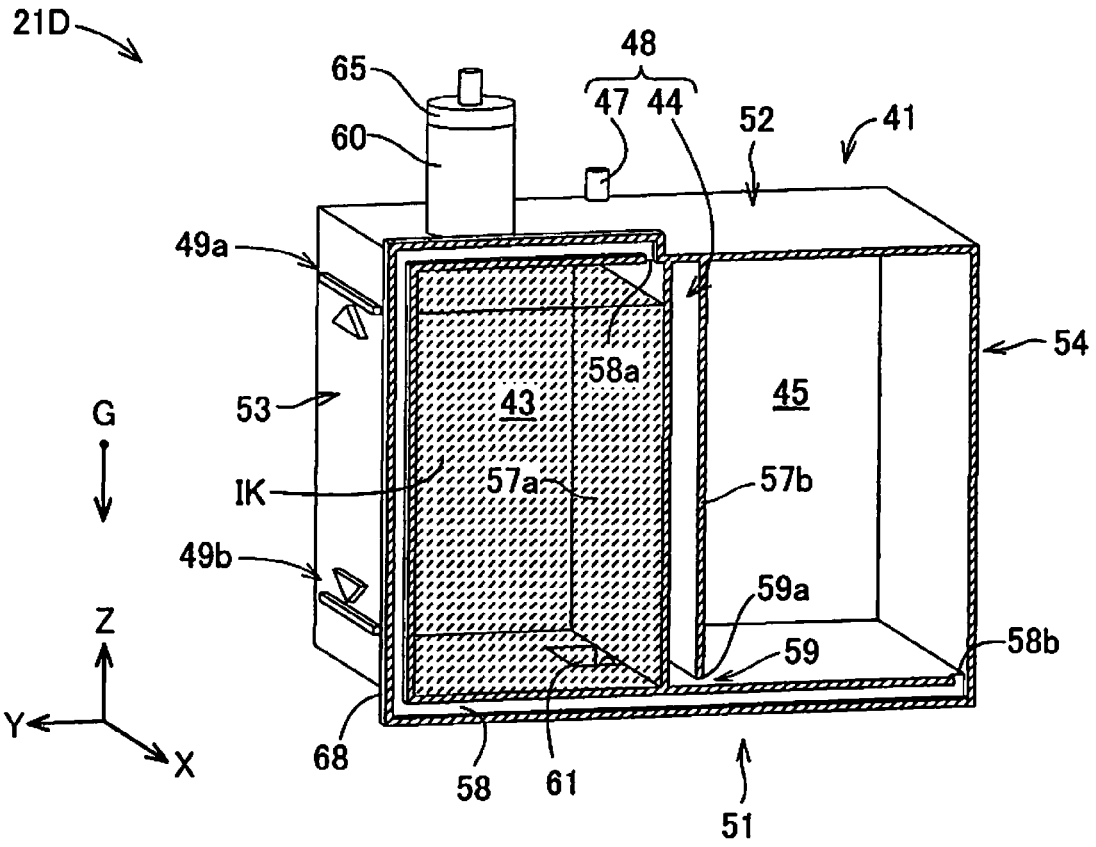
FIG. 17 is a schematic perspective view showing an ink tank according to a fourth embodiment in the first orientation.

The following describes a configuration of an ink tank 21D according to a fourth embodiment of the invention with reference to FIGS. 17 to 22 one by one. In FIGS. 17 to 22, the sheet member 42 and the tube 23 connected to the ink supply part 61 are omitted for the sake of convenience. FIG. 17 is a schematic perspective view showing the ink tank 21D according to the fourth embodiment in the first orientation seen from the right side surface side. The ink tank 21D according to the fourth embodiment has the same configuration as the ink tank 21C according to the third embodiment, except for the points described below. The ink tank 21D according to the fourth embodiment is installed to a printer that has the same configuration as the printer 10 described in the first embodiment (FIGS. 1 and 2), in the same orientation as the orientation of the ink tank 21A according to the first embodiment.

In the ink tank 21D, the air flow channel 44 is provided between the ink container part 43 and the buffer part 45. In the ink tank 21D, the first inner wall 57*a* separates the ink container part 43 and the air flow channel 44 from each other, and the second inner wall 57*b* is located closer to the first inner wall 57*a* than to the fourth wall 54.

In the ink tank 21D, the protruding portion 68 in which the first communication path 58 is formed is extended to an area of the second wall 52 above the ink container part 43. The protruding portion 68 is also extended to the end portion of the first wall 51 on the rear surface side. The first communication path 58 is connected to a corner between the second wall 52 and the first inner wall 57*a*, the corner being the upper end portion of the ink container part 43 on the rear surface side. The first communication path 58 is also connected to a corner between the fourth wall 54, which is an end portion of the buffer part 45 on the rear surface side, and the first wall 51.

Figure 18:
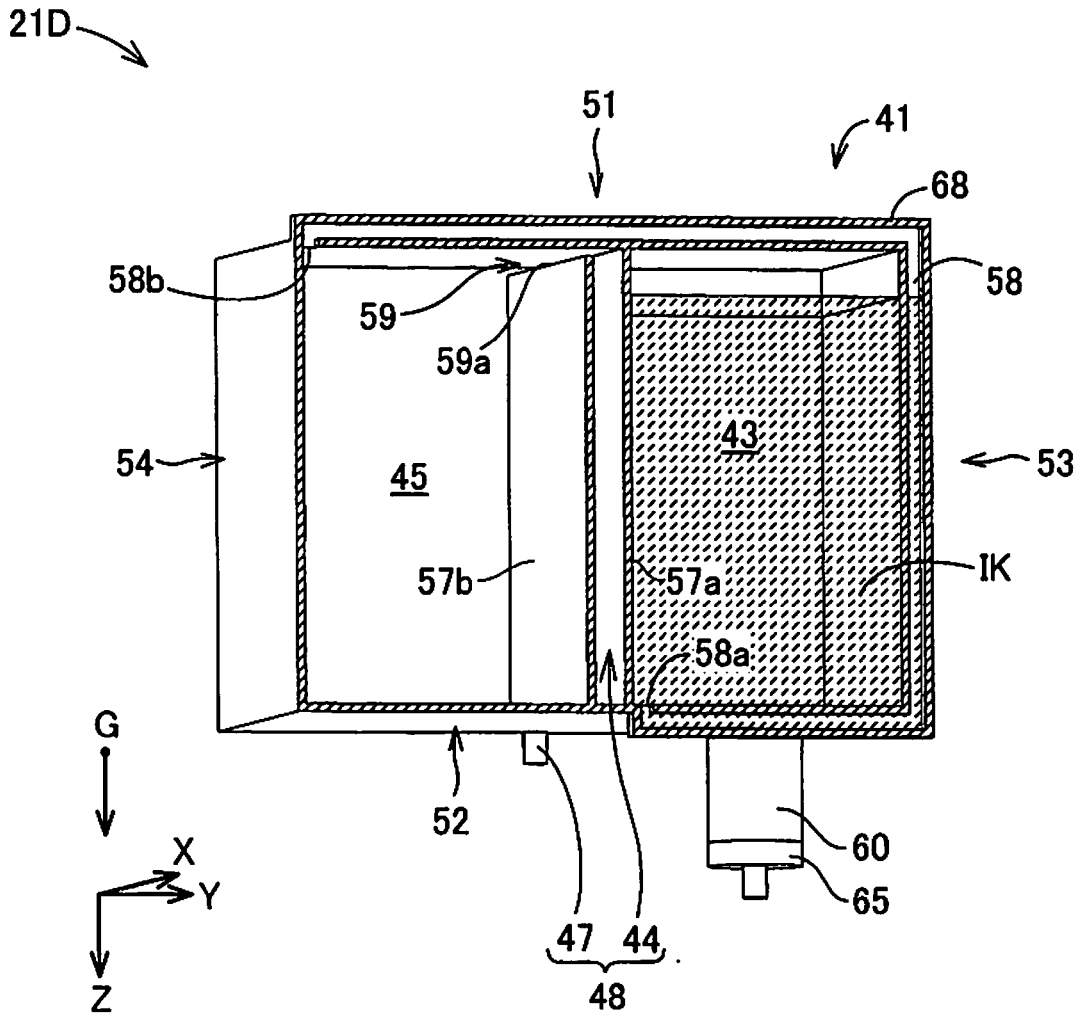
FIG. 18 is a schematic perspective view showing the ink tank according to the fourth embodiment in the second orientation.

FIG. 18 illustrates the state of the ink tank 21D in the second orientation. When the ink tank 21D is in the second orientation, the first communication path 58 extends to the first wall 51 located at the upper end of the ink container part 43. Therefore, ink IK that has flown into the first communication path 58 is unlikely to reach the buffer part 45. Also, even when the environment in which the printer 10 is disposed is changed and the ink IK in the ink container part 43 is pushed out to the first communication path 58 due to the expansion of air, almost all the amount of ink IK can be retained in the buffer part 45.

Figure 19:
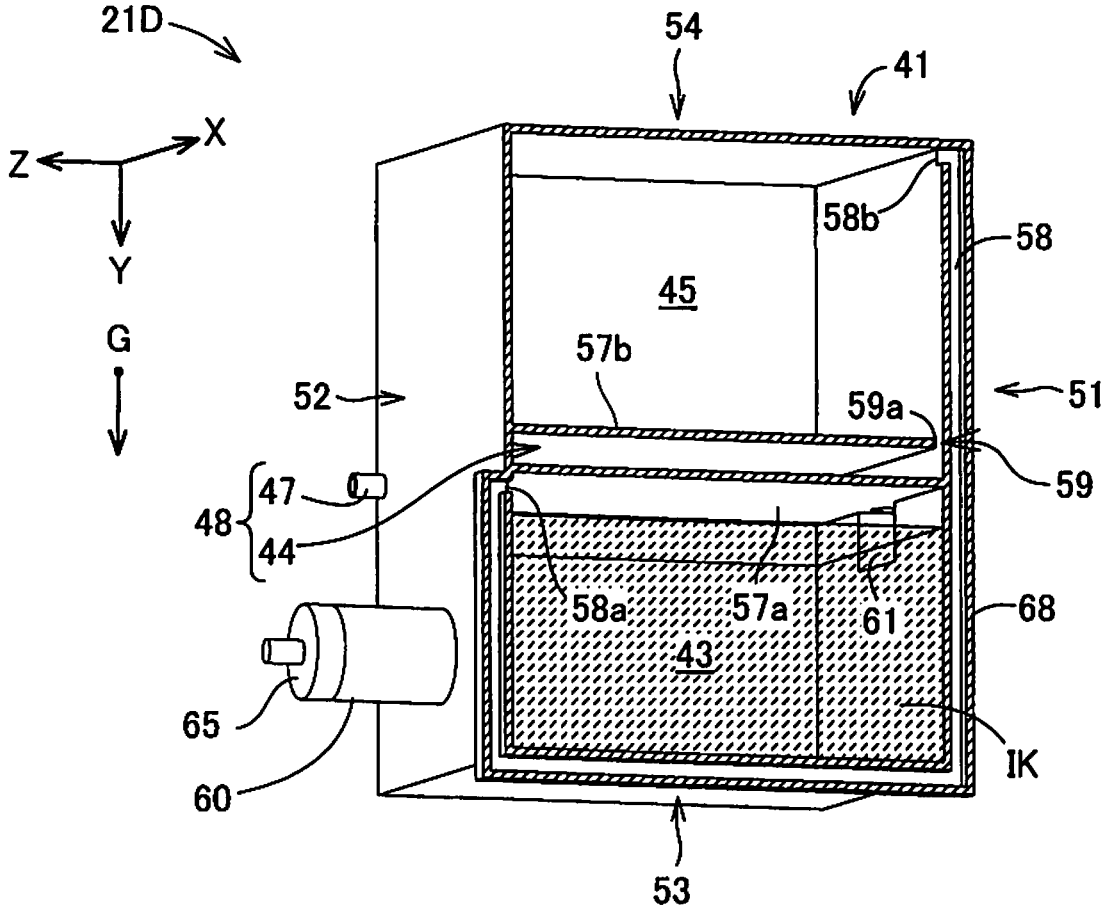
FIG. 19 is a schematic perspective view showing the ink tank according to the fourth embodiment in the third orientation.

FIG. 19 illustrates the state of the ink tank 21D in the third orientation. When the ink tank 21D is in the third orientation, the opening end 58*a* of the first communication path 58 is located in an area in the ink container part 43 where air is present. Therefore, the ink IK in the ink container part 43 is unlikely to flow into the first communication path 58, and is prevented from reaching the buffer part 45 and the air introduction part 48. Also, even when the environment in which the printer 10 is disposed is changed and ink IK in the ink container part 43 expands, air can flow to the outside of the ink tank 21D via the first communication path 58, and the pressure in the ink tank 21D is prevented from increasing.

Figure 20:
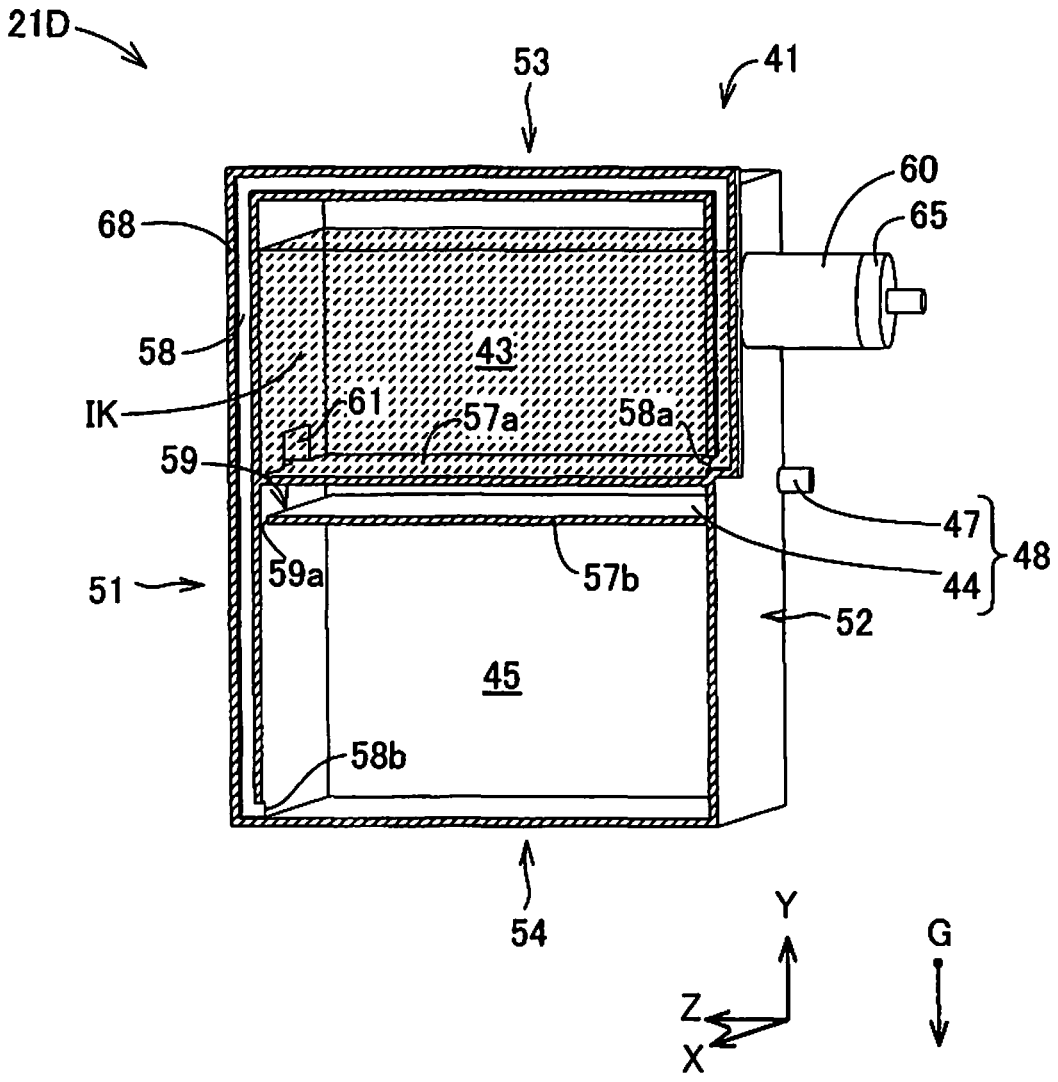
FIG. 20 is a schematic perspective view showing the ink tank according to the fourth embodiment in the fourth orientation.

FIG. 20 illustrates the state of the ink tank 21D in the fourth orientation. When the ink tank 21D is in the fourth orientation, in the same manner as in the case of the second orientation, the first communication path 58 extends to the third wall 53 located at the upper end of the ink container part 43. Therefore, ink IK is unlikely to reach the buffer part 45. Also, even when the environment in which the printer 10 is disposed is changed and the ink IK in the ink container part 43 is pushed out to the first communication path 58 due to the expansion of air, almost all the amount of ink IK can be retained in the buffer part 45 located below the air flow channel 44.

Figure 21:
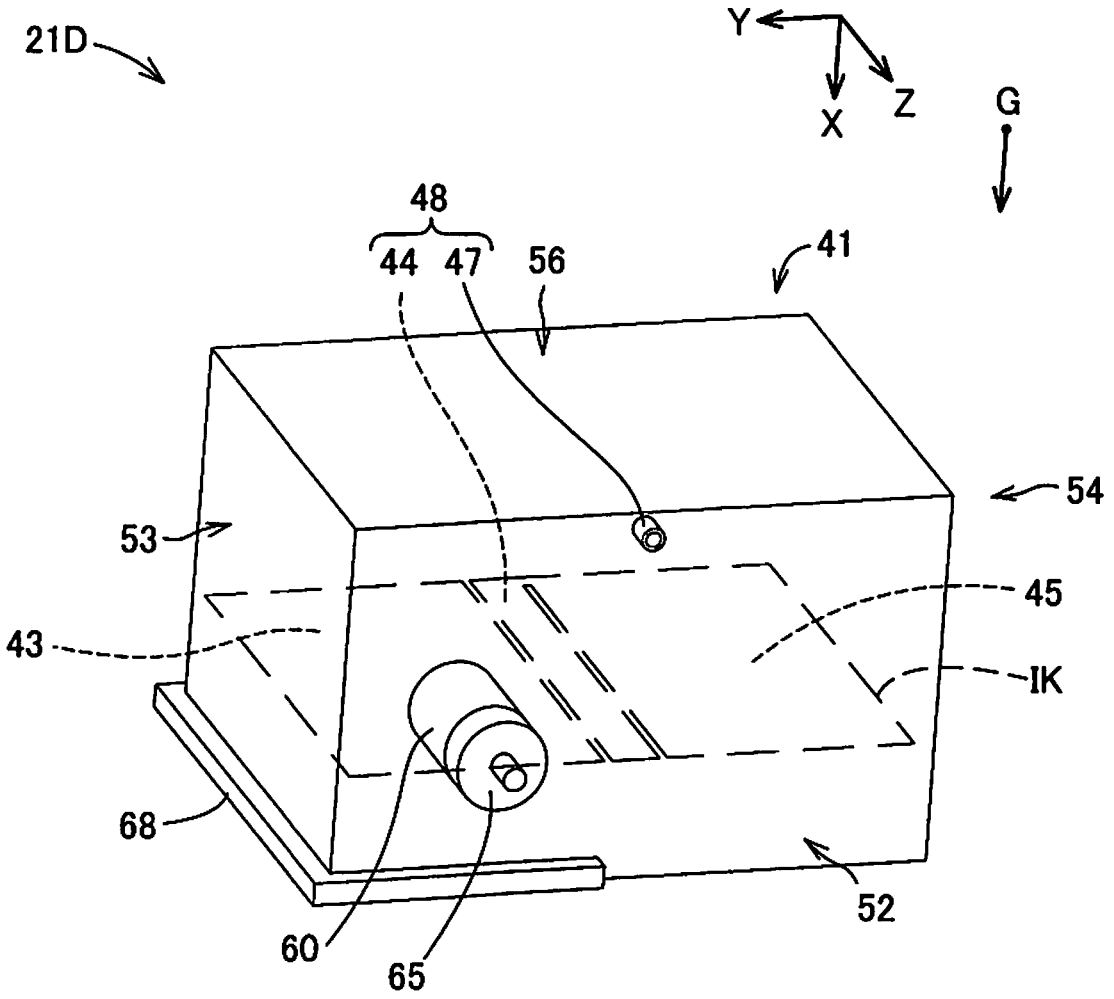
FIG. 21 is a schematic perspective view showing the ink tank according to the fourth embodiment in the fifth orientation.

FIG. 21 illustrates the state of the ink tank 21D in the fifth orientation. When the ink tank 21D is in the fifth orientation, the air intake part 47 is located in an area in the air flow channel 44 where air is present. Therefore, ink IK is prevented from leaking via the air intake part 47. Also, even when the environment in which the printer 10 is disposed is changed and air in the ink container part 43 expands, almost all the amount of ink IK stored in the ink container part 43 can be retained in the buffer part 45 and the air flow channel 44.

Figure 22:
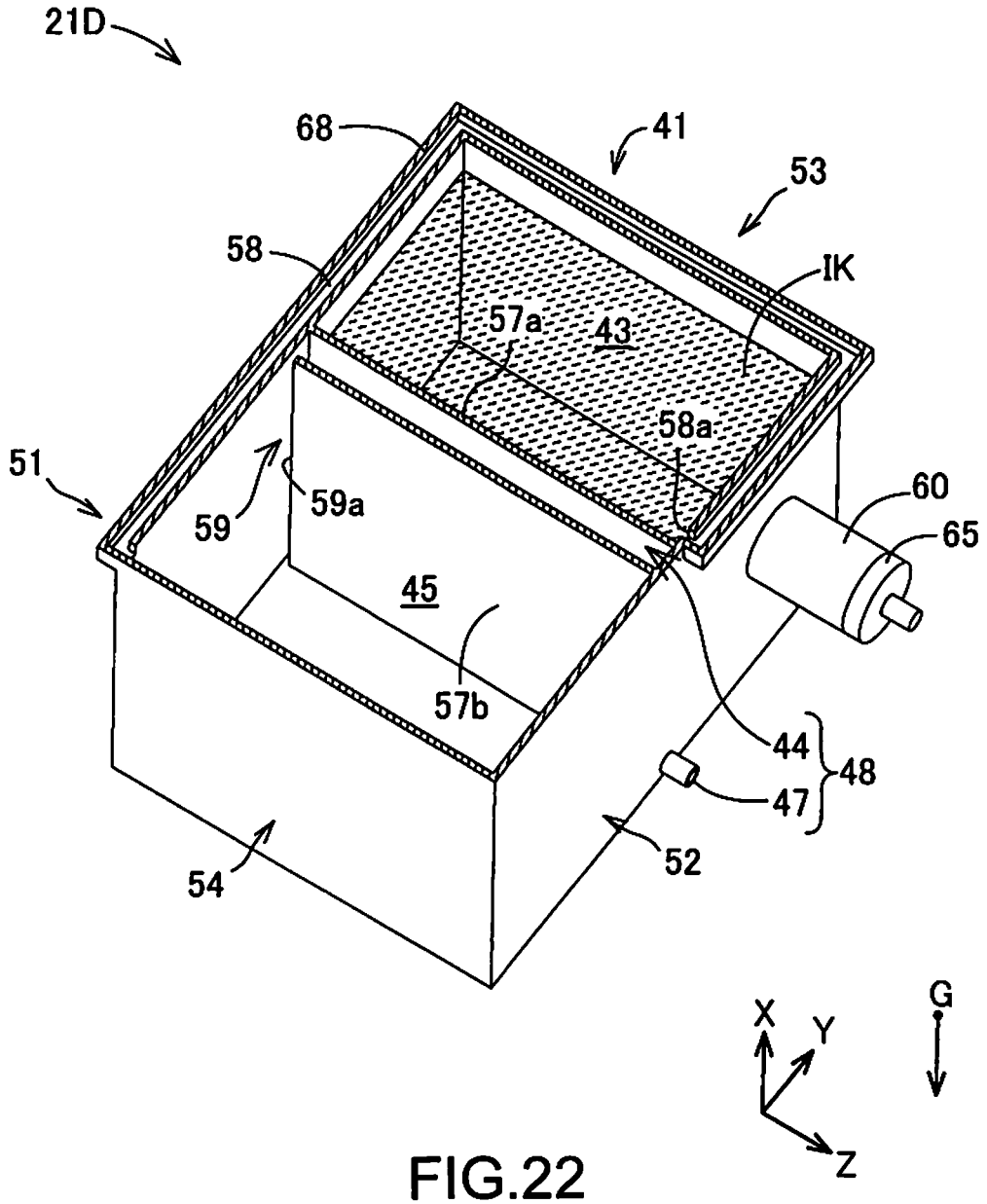
FIG. 22 is a schematic perspective view showing the ink tank according to the fourth embodiment in the sixth orientation.

FIG. 22 illustrates the state of the ink tank 21D in the sixth orientation. When the ink tank 210 is in the sixth orientation, the opening end 58*a* of the first communication path 58 is located in an area of the ink container part 43 where air is present, and the state in which ink IK is retained in the ink container part 43 is maintained. Also, even when the environment in which the printer 10 is disposed is changed and air in the ink container part 43 expands, the air can flow to the outside via the first communication path 58, and the pressure in the ink tank 21D is prevented from increasing.

As described above, with the ink tank 21D according to the fourth embodiment, as with the ink tank 21C according to the third embodiment, the ink IK is prevented from leaking from the ink tank 21D in various orientations. In addition, with the ink tank 21D according to the fourth embodiment and the printer provided with the same, various functions and effects that are similar to those described in the embodiments above can be achieved.

E. Fifth Embodiment

Figure 23:
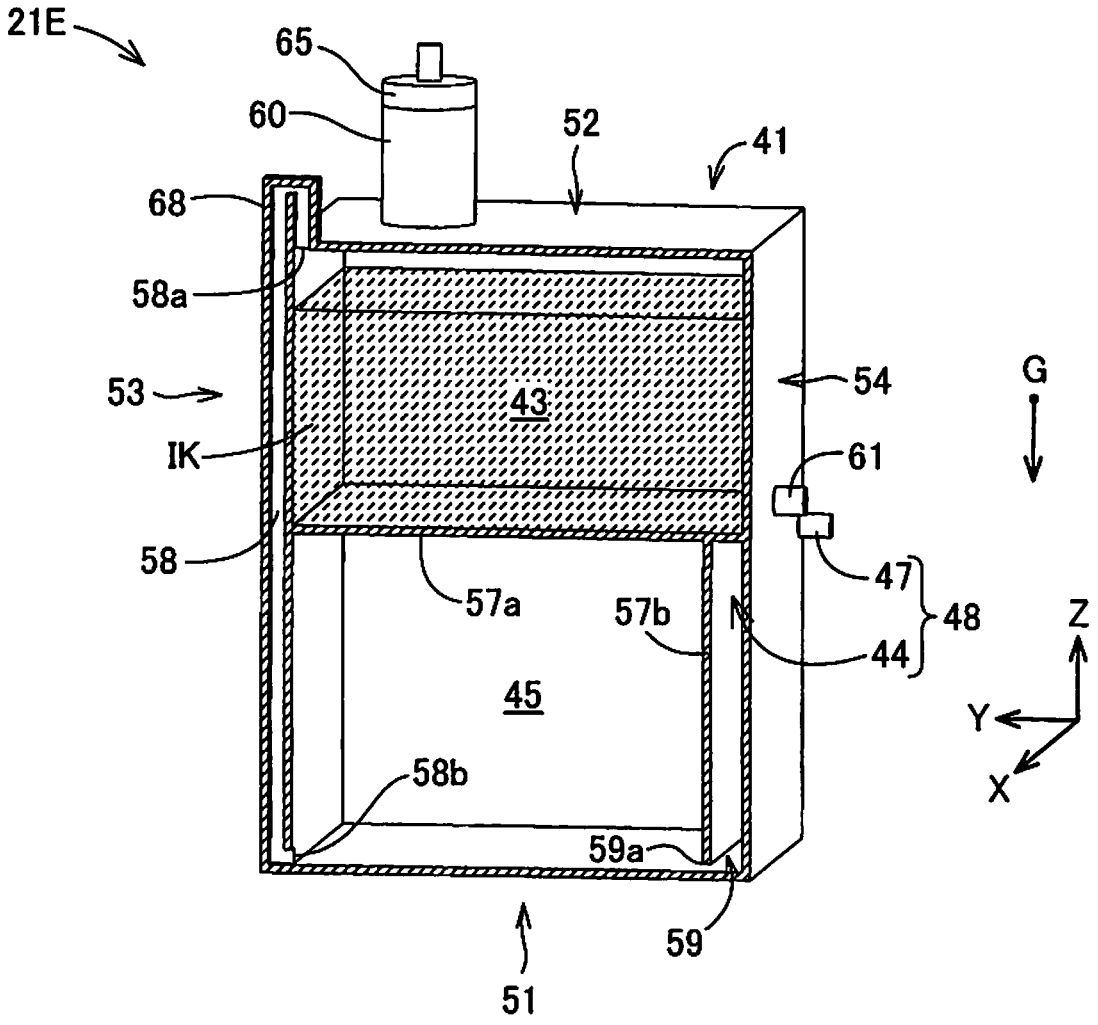
FIG. 23 is a schematic perspective view showing an ink tank according to a fifth embodiment in the first orientation.

The following describes a configuration of an ink tank 21E according to a fifth embodiment of the invention with reference to FIGS. 23 to 28 one by one. In FIGS. 23 to 28, the sheet member 42, and the tube 23, which is connected to the ink supply part 61, are omitted for the sake of convenience. FIG. 23 is a schematic perspective view showing the ink tank 21E according to the fifth embodiment in the first orientation seen from the right side surface side.

The ink tank 21E according to the fifth embodiment has the same configuration as the ink tank 21C according to the third embodiment, except for the points described below. The ink tank 21E according to the fifth embodiment is installed to a printer that has the same configuration as the printer 10 described in the first embodiment (FIGS. 1 and 2), in the same orientation as the orientation of the ink tank 21A according to the first embodiment. The ink tank 21E according to the fifth embodiment is configured such that when the ink tank 21E is in the first orientation, the buffer part 45 and the air flow channel 44 are located below the ink container part 43. Accordingly, the position where the ink supply part 61 is formed, the position where the air intake part 47 is attached, and the position where the protruding portion 68 having the first communication path 58 is formed are changed.

The ink tank 21E has an approximately cuboid shape, and when the ink tank 21E is in the first orientation, the buffer part 45 and the air introduction part 48 are arranged in the stated order below the ink container part 43, along the direction opposite to the direction indicated by the arrow Y. In the ink tank 21E, the first inner wall 57*a* extends along the direction indicated by the arrow X and the direction indicated by the arrow Y so as to separate the ink container part 43, the buffer part 45, and the air flow channel 44 from each other. Also, the second inner wall 57*b* extends between the buffer part 45 and the air flow channel 44 along the entire length in the direction indicated by the arrow X, and extends downward from the first inner wall 57*a*. In the ink tank 21E, the ink supply part 61 is provided in the fourth wall 54 at a position that allows communication with the lower end portion of the ink container part 43. Also, the air intake part 47 is provided in the end portion of the fourth wall 54 on the fifth wall 55 side at a position that allows communication with the upper end portion of the air flow channel 44.

In the ink tank 21E, the protruding portion 68 in which the first communication path 58 is provided slightly protrudes above from the second wall 52 at the end portion on the third wall 53 side, and extends to the lower end of the buffer part 45 along the right side end portion of the third wall 53. The first communication path 58 slightly protrudes upward from a corner at the right side upper end of the ink container part 43, then turns back and toward the front surface side and extends below, and is connected to the lower end of the buffer part 45. The opening end 58*a* of the first communication path 58 in the ink container part 43 is located at a corner that is at the right side upper end of the ink container part 43, and is open in the area where air is present. The opening end 58*b* of the first communication path 58 in the buffer part 45 is located at the right side lower end portion of the buffer part 45.

Figure 24:
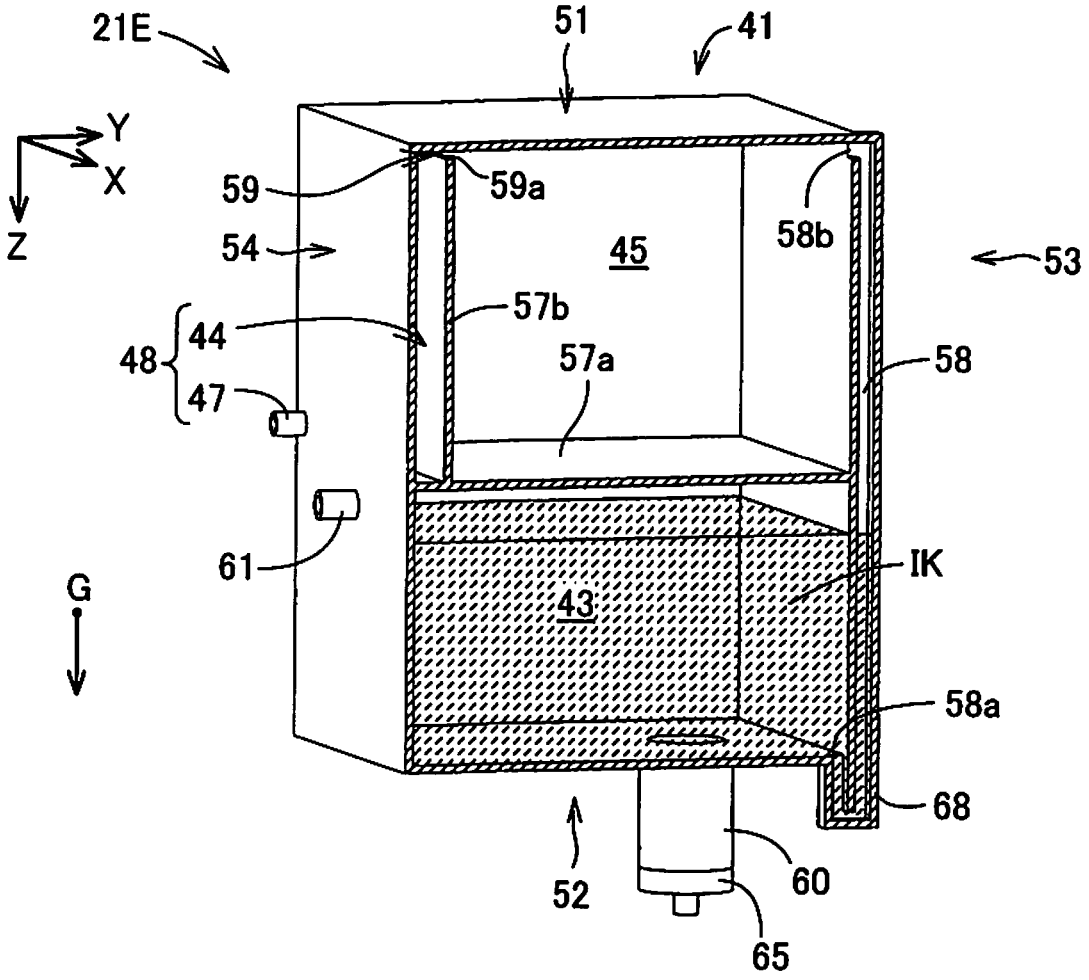
FIG. 24 is a schematic perspective view showing the ink tank according to the fifth embodiment in the second orientation.

FIG. 24 illustrates the state of the ink tank 21E in the second orientation. When the ink tank 21E is in the second orientation, the ink IK in the ink container part 43 flows into the first communication path 58, but is unlikely to reach the buffer part 45 because the first communication path 58 extends to the first wall 51 located at the upper end. Also, even when the environment in which the printer 10 is disposed is changed and the ink IK in the ink container part 43 is pushed out to the buffer part 45 via the first communication path 58 due to the expansion of air, the ink IK is retained in the buffer part 45.

Figure 25:
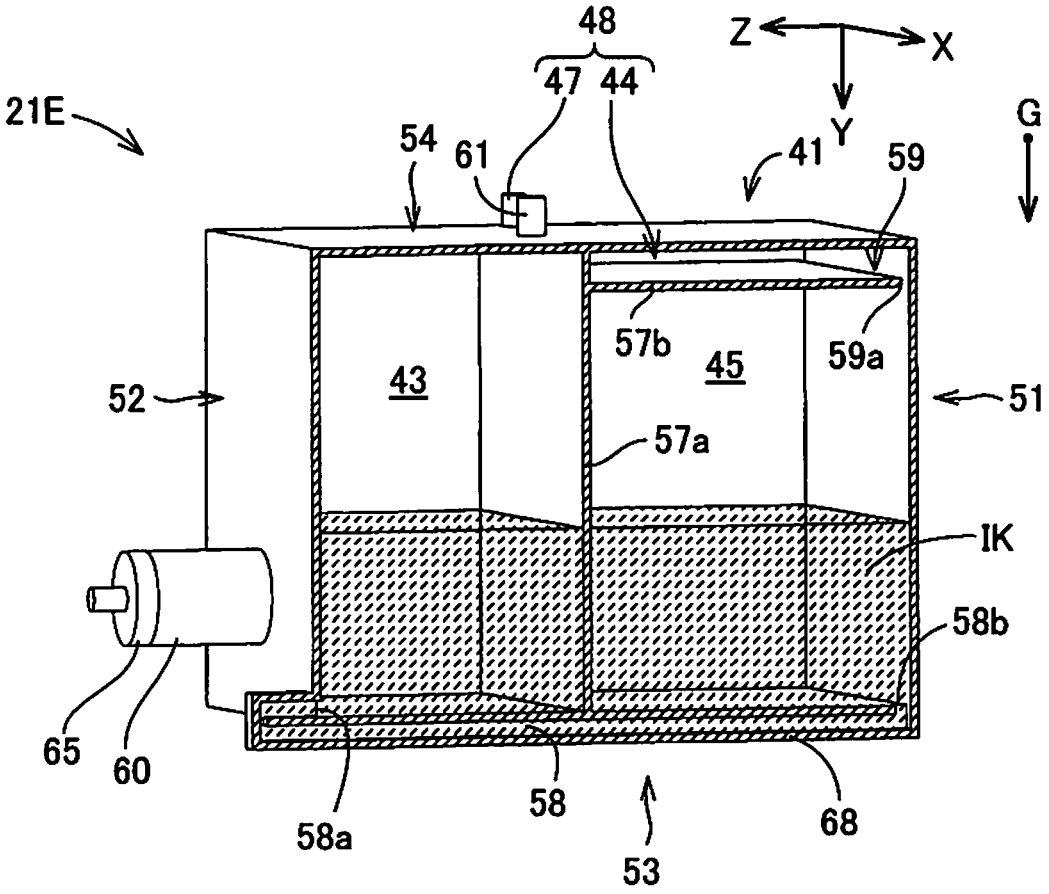
FIG. 25 is a schematic perspective view showing the ink tank according to the fifth embodiment in the third orientation.

FIG. 25 illustrates the state of the ink tank 21E in the third orientation. When the ink tank 21E is in the third orientation, the ink IK in the ink container part 43 flows into the buffer part 45 via the first communication path 58, but is unlikely to reach the air flow channel 44 located above the buffer part 45. Even when the environment in which the printer 10 is disposed is changed and the ink IK in the ink container part 43 is pushed out due to the expansion of air, almost all the amount of the pushed out ink IK can be stored in the buffer part 45, and therefore the ink IK is prevented from reaching the air flow channel 44.

Figure 26:
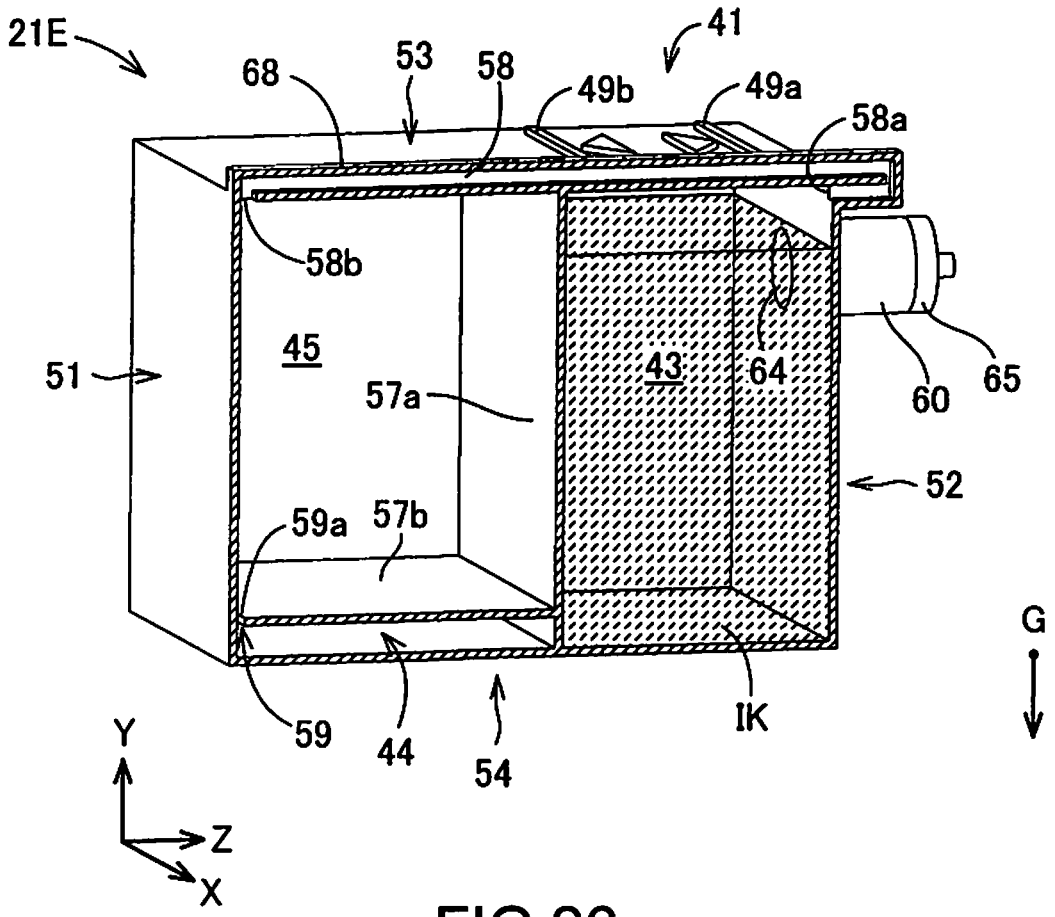
FIG. 26 is a schematic perspective view showing the ink tank according to the fifth embodiment in the fourth orientation.

FIG. 26 illustrates the state of the ink tank 21E in the fourth orientation. When the ink tank 21E is in the fourth orientation, the opening end 58*a* of the first communication path 58 is located in an area in the ink container part 43 where air is present. Therefore, the ink IK in the ink container part 43 is unlikely to flow into the first communication path 58, and is prevented from reaching the buffer part 45 and the air introduction part 48. Also, even when the environment in which the printer 10 is disposed is changed and air in the ink container part 43 expands, the air can flow to the outside via the first communication path 58, and the pressure in the ink container part 43 is prevented from increasing.

Figure 27:
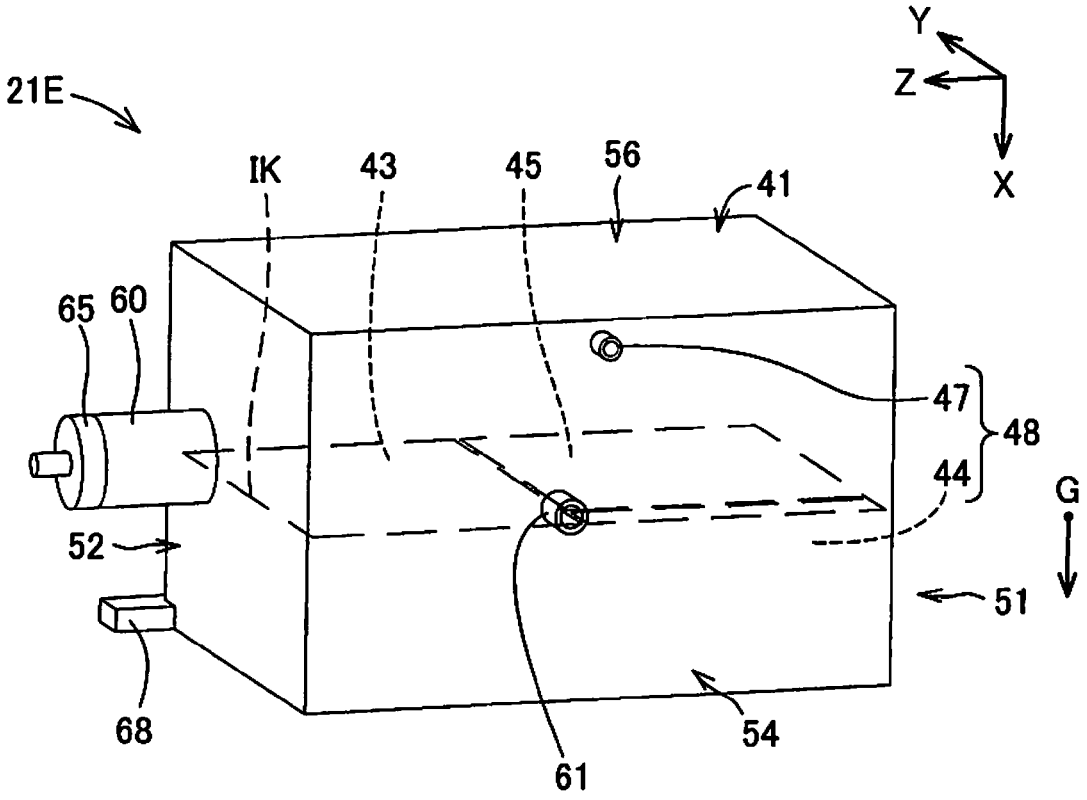
FIG. 27 is a schematic perspective view showing the ink tank according to the fifth embodiment in the fifth orientation.

FIG. 27 illustrates the state of the ink tank 21E in the fifth orientation. When the ink tank 21E is in the fifth orientation, the air intake part 47 is located in an area in the air flow channel 44 where air is present, and therefore ink IK is unlikely to reach the air intake part 47. Also, even when the environment in which the printer 10 is disposed is changed and air in the ink container part 43 expands, almost all the amount of ink IK stored in the ink container part 43 can be retained in the buffer part 45 and the air flow channel 44.

Figure 28:
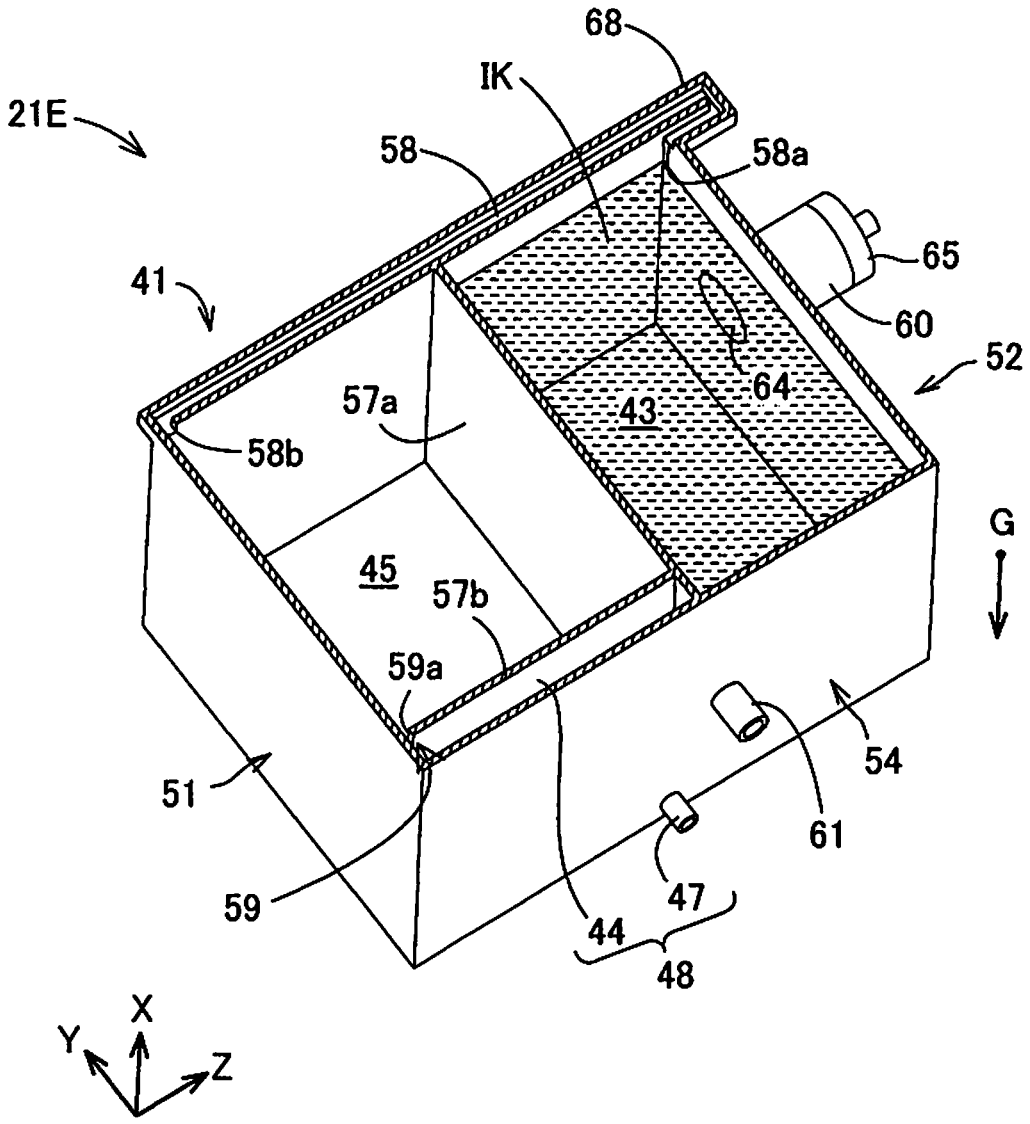
FIG. 28 is a schematic perspective view showing the ink tank according to the fifth embodiment in the sixth orientation.

FIG. 28 illustrates the state of the ink tank 21E in the sixth orientation. When the ink tank 21E is in the sixth orientation, the opening end 58*a* of the first communication path 58 is located in an area in the ink container part 43 where air is present, and the state in which ink IK is retained in the ink container part 43 is maintained. Also, even when the environment in which the printer 10 is disposed is changed and air in the ink container part 43 expands, the air can flow to the outside via the first communication path 58, and the pressure in the ink container part 43 is prevented from increasing.

As described above, with the ink tank 21E according to the fifth embodiment, as with the ink tank 21C according to the third embodiment, the ink IK is prevented from leaking from the ink tank 21E in various orientations. In addition, with the ink tank 21E according to the fifth embodiment and the printer provided with the same, various functions and effects that are similar to those described in the embodiments above can be achieved.

F. Sixth Embodiment

Figure 29:
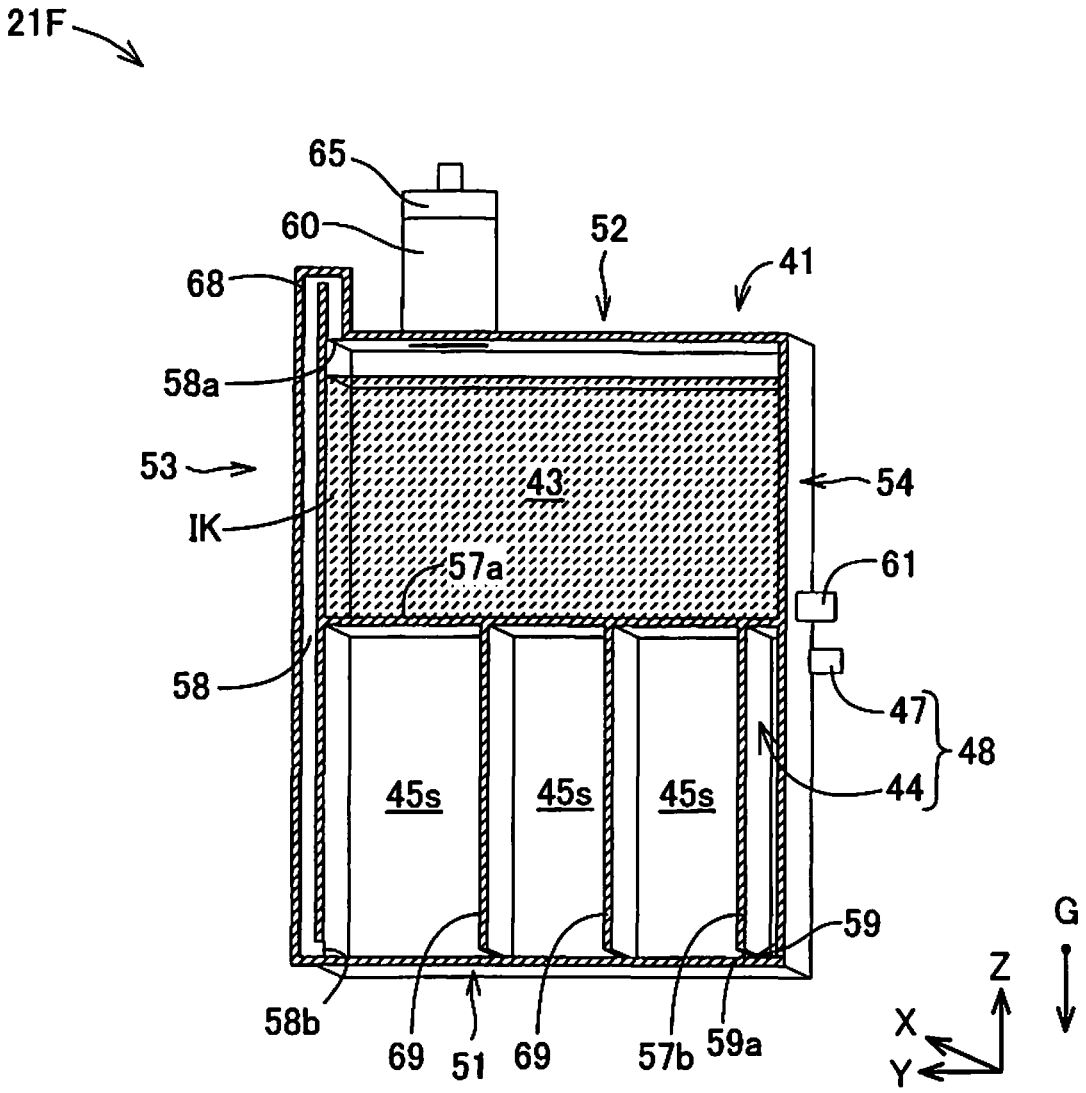
FIG. 29 is a schematic perspective view showing an ink tank according to a sixth embodiment in the first orientation.

FIG. 29 is a schematic perspective view showing a configuration of an ink tank 21F according to a sixth embodiment of the invention. FIG. 29 is a diagram showing the ink tank 21F in the first orientation seen from the right side surface side. In FIG. 29, the sheet member 42 and the tube 23 connected to the ink supply part 61 are omitted for the sake of convenience. The configuration of the ink tank 21F according to the sixth embodiment is approximately the same as the configuration of the ink tank 21E according to the fifth embodiment, except for that the buffer part 45 is divided into a plurality of spaces. The ink tank 21F according to the sixth embodiment is installed to a printer that has the same configuration as the printer 10 described in the first embodiment (FIGS. 1 and 2), in the same orientation as the orientation of the ink tank 21A according to the first embodiment.

In the ink tank 21F, the buffer part 45 is divided into a plurality of small spaces 45*s* by a plurality of partition walls 69 that have a configuration similar to the second inner wall 57*b* and are arranged within the buffer part 45 along the direction indicated by the arrow Y at appropriate intervals. In the following, the spaces 45*s* are also referred to as "a plurality of divided buffer parts 45*s*". In the ink tank 21F, the total of the respective capacities of the plurality of divided buffer parts 45*s* is approximately the same or larger than the volume of the ink IK in the ink container part 43.

With the ink tank 21F according to the sixth embodiment, as with the ink tank 21E according to the fifth embodiment, the ink IK is prevented from leaking from the ink tank 21F in various orientations. Also, with the ink tank 21F according to the sixth embodiment, the buffer part 45 is divided into a plurality of divided buffer parts 45*s*, and therefore the ink IK that has flown into the buffer part 45 is unlikely to reach the air flow channel 44. Therefore, ink IK is further prevented from leaking. In addition, with the ink tank 21F according to the sixth embodiment and the printer provided with the same, various functions and effects that are similar to those described in the embodiments above can be achieved.

G. Seventh Embodiment

Figure 30:
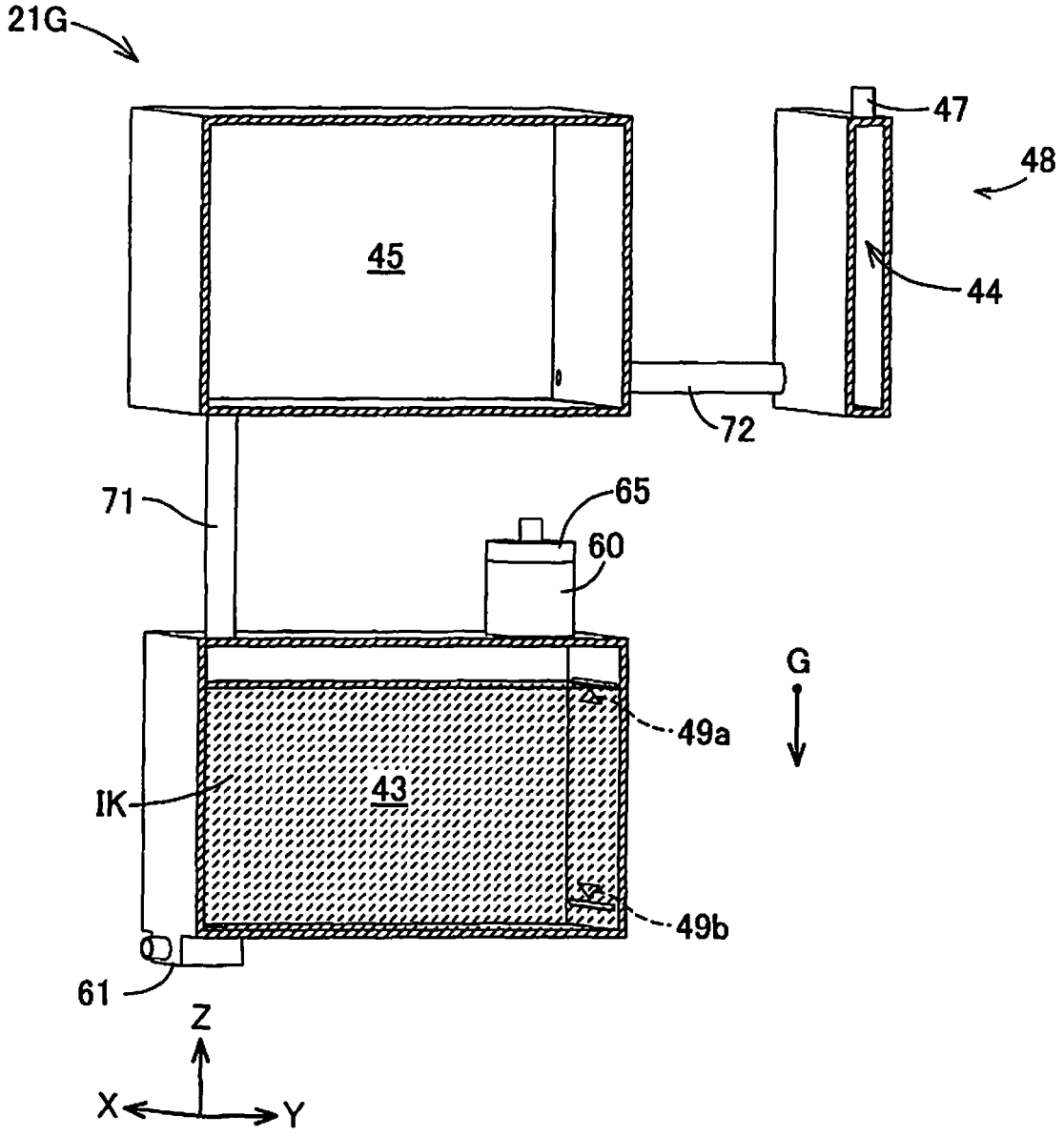
FIG. 30 is a schematic view showing a configuration of an ink tank according to a seventh embodiment.

FIG. 30 is a schematic view showing a configuration of an ink tank 21G according to a seventh embodiment of the invention. In the ink tank 21G according to the seventh embodiment, the ink container part 43, the buffer part 45, and the air flow channel 44 are respectively constituted by containers that each have an approximately cuboid shape and that are separated from each other. The capacity of the buffer part 45 is approximately the same or larger than the volume of the ink IK in the ink container part 43. The left side surfaces of the ink container part 43, the buffer part 45, and the air flow channel 44 are sealed with a sheet member (not shown) that is similar to the sheet member 42 described in the first embodiment.

In the ink tank 21G, as in the ink tank 21A according to the first embodiment, the ink container part 43 is located below the buffer part 45, and the buffer part 45 and the air flow channel 44 are arranged along the direction indicated by the arrow Y. In the ink tank 21G, the ink container part 43 and the buffer part 45 are connected to each other by a first pipe member 71, and the buffer part 45 and the air flow channel 44 are connected to each other by a second pipe member 72.

The first pipe member 71 and the second pipe member 72 are not flexible, and fix the ink container part 43, the buffer part 45, and the air flow channel 44 such that their above-described relative positions do not change. The ink container part 43, the buffer part 45, and the air flow channel 44 may have a coupling member that fixes themselves to each other in addition to the two pipe members 71 and 72, or fixed within the casing of the printer such that their respective relative positions are fixed.

The first pipe member 71 corresponds to the first communication path 58 in the first embodiment, and connects the left upper end portion of the rear surface side end portion of the ink container part 43 and the left lower end portion of the rear surface side end portion of the buffer part 45. The second pipe member 72 corresponds to the second communication path 59 in the first embodiment, and connects the right lower end portion of the front surface side end portion of the buffer part 45 and the left lower end portion of the rear surface side end portion of the air flow channel 44.

The ink tank 21G according to the seventh embodiment is substantially provided with a flow channel structure corresponding to the ink tank 21A according to the first embodiment. As described above, with the ink tank 21G according to the seventh embodiment, as with the ink tank 21A according to the first embodiment, the ink IK is prevented from leaking from the ink tank 21G in various orientations. In addition, with the ink tank 21G according to the seventh embodiment and the printer provided with the same, various functions and effects that are similar to those described in the embodiments above can be achieved.

H. Eighth Embodiment

Figure 31:
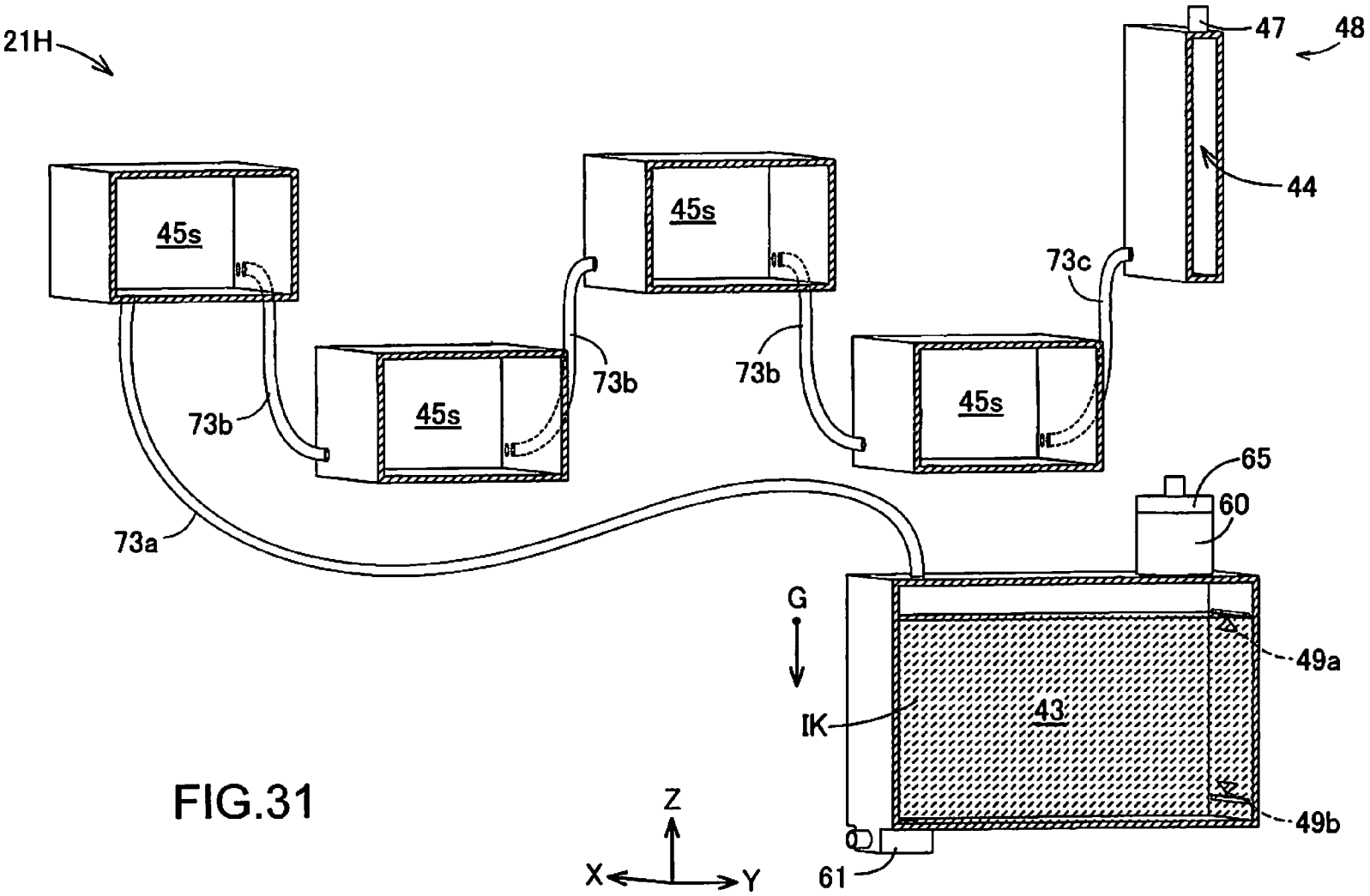
FIG. 31 is a schematic view showing a configuration of an ink tank according to an eighth embodiment.

FIG. 31 is a schematic view showing a configuration of an ink tank 21H according to an eighth embodiment of the invention. The ink tank 21H according to the eighth embodiment has the same configuration as the ink tank 21G according to the seventh embodiment, except for that the ink tank 21H is provided with a plurality of divided buffer parts 45*s* instead of the buffer part 45, and is provided with a plurality of flexible tubes 73*a* to 73*c* instead of the pipe members 71 and 72 that are not flexible.

The plurality of divided buffer parts 45*s* configured by containers that each have an approximately cuboid shape and that are independent from each other. The total of the respective capacities of the plurality of divided buffer parts 45*s* is approximately the same or larger than the volume of the ink IK in the ink container part 43. The ink container part 43, the divided buffer parts 45*s*, and the air flow channel 44 are fixed to the casing of the printer such that their respective relative positions are fixed. The ink container part 43 is located below the divided buffer parts 45*s* and the air flow channel 44. The divided buffer parts 45*s* may be alternatingly arranged at upper and lower levels as shown in the drawing, or at the same level.

The ink container part 43 and one of the divided buffer parts 45*s* are in communication via the first tube 73*a*. The first tube 73*a* connects the left upper end portion of the rear surface side end portion of the ink container part 43 and the left lower end portion of the rear surface side end portion of the divided buffer parts 45*s*. The divided buffer parts 45*s* are connected in series via the second tubes 73*b*. One second tube 73*b* is connected to the respective lower end of adjacent divided buffer parts 45*s*. The divided buffer part 45*s* at an end and the air flow channel 44 are connected via a third tube 73*c*. The third tube 73*c* connects the lower end of the divided buffer part 45*s* and the lower end of the air flow channel 44.

The ink tank 21H according to the eighth embodiment is substantially provided with a flow channel structure corresponding to the ink tank 21G according to the seventh embodiment. However, since the ink tank 21H according to the eight embodiment is provided with the plurality of divided buffer parts 45*s* instead of the buffer part 45, the ink IK in the ink container part 43 is more unlikely to reach the air flow channel 44. As described above, with the ink tank 21H according to the eighth embodiment, the ink IK is further prevented from leaking from the ink tank 21H in various orientations compared to the ink tank 21G according to the seventh embodiment. In addition, with the ink tank 21H according to the eighth embodiment and the printer provided with the same, various functions and effects that are similar to those described in the embodiments above can be achieved.

I. Modifications

The configurations of the above-described embodiments may be variously modified or changed as described in the modifications below. In the following description, when it is unnecessary to distinguish the ink tanks 21A to 21H according to the respective embodiments from each other, they are collectively referred to as "the ink tank 21". Also, the "buffer part 45" refers to the plurality of divided buffer parts 45*s* as well if not otherwise specified.

I1. Modification 1:

In the above-described embodiment, the buffer part 45 is configured such that when the ink tank 21 is in the first orientation, the capacity of the area above the opening end 59*a* of the second communication path 59 is approximately equal to or larger than the volume of the ink IK in the ink container part 43. The volume of the ink IK in the ink container part 43 is the upper limit of the volume of ink IK that can be stored in the ink container part 43, and the volume of ink IK when the ink container part 43 is fully filled with ink IK and no air is remaining. However, "the volume of the ink IK in the ink container part 43" is not necessarily the volume of ink IK when the ink container part 43 is fully filled with ink IK, and may be the upper limit of the volume of ink IK that is expected to be stored in the ink container part 43. For example, the volume of the ink IK in the ink container part 43 may be the volume of the ink IK when the liquid surface of the ink IK is located at the position indicated by the first mark part 49*a* when the ink tank 21 is in the first orientation. Note that in the present specification, "approximately the same" means that an error within the range of ±10% may be included, for example.

I2. Modification 2:

In the above-described embodiments, the opening end 58*a* of the first communication path 58 on the ink container part 43 side is located at the upper end portion of the ink container part 43. The position of the opening end 58*a* of the first communication path 58 in the ink container part 43 is not limited to the upper end portion of the ink container part 43. The position of the opening end 58*a* of the first communication path 58 in the ink container part 43 only needs to be a position from which air can be introduced into the ink container part 43 when the ink tank 21 is in the first orientation, and a position in an area where air is present in the ink container part 43 when the ink tank 21 is in the first orientation. More specifically, the opening end 58*a* of the first communication path 58 only needs to be located at a position where air is present when the ink tank 21 is in the first orientation and ink IK having a volume that is half the capacity of the ink container part 43 is stored in the ink container part 43. Alternatively, the opening end 58*a* of the first communication path 58 may be located above the first mark part 49*a* when the ink tank 21 is in the first orientation.

I3. Modification 3:

In the above-described embodiments, the opening end 58*b* of the first communication path 58 on the buffer part 45 side as well as the opening end 59*a* of the second communication path 59 on the buffer part 45 side are located at the upper end of the buffer part 45. However, the opening end 58*b* of the first communication path 58 and the opening end 59*a* of the second communication path 59 are not necessarily located at the upper end of the buffer part 45. The opening end 58*b* of the first communication path 58 and the opening end 59*a* of the second communication path 59 only need to be located such that when the ink tank 21 is in the first orientation, a space that has a sufficient capacity to store ink IK having a volume that is approximately equal to or larger than the volume of the ink IK in the ink container part 43 can be secured above the opening end 58*b* and the opening end 59*a*. The opening end 58*b* of the first communication path 58 and the opening end 59*a* of the second communication path 59 may be located at different levels. If this is the case, it is only necessary that a space having a sufficient capacity to store the above-described ink IK is located above one out of the opening ends 58*b* and 59*a* at the higher level when the ink tank 21 is in the first orientation.

I4. Modification 4:

In the above-described embodiments, the second communication path 59 is formed as a gap between the end portion of the second inner wall 57*b* and a wall facing the end portion. However, the second communication path 59 only needs to be configured such that the buffer part 45 and the air flow channel 44 are in communication with each other, and the second communication path 59 may have another configuration. The second communication path 59 may be formed as an approximately rectangular cut-out recessed portion in the second inner wall 57*b* as the first communication path 58 is, for example. Also, the second communication path 59 does not necessarily extend straight, and may be curved and mender, for example.

I5. Modification 5:

In the ink tank 21C according to the third embodiment and the ink tank 21D according to the fourth embodiment in the first orientation, the air intake part 47 is provided at an approximately same level as the opening end 58*a* of the first communication path 58 (FIGS. 11 and 17). In the ink tank 21E according to the fifth embodiment and the ink tank 21F according to the sixth embodiment, the air intake part 47 is provided at a position lower than the opening end 58*a* (FIGS. 23 and 29) of the first communication path 58. In the other embodiments, the air intake part 47 is located at a position higher than the opening end 58*a* of the first communication path 58 when the ink tank 21 is in the first orientation. Note that in each embodiment, the air intake part 47 is located in an upper end portion that is located at an upper end of the air flow channel 44 when the ink tank 21 is in the first orientation. However, the position of the air intake part 47 is not limited to the upper edge portion of the air flow channel 44, and may be formed at another position. For example, in the ink tank 21A according to the first embodiment, the air intake part 47 may be formed in the vicinity of the center of the air flow channel 44 in the direction indicated by the arrow Z so as to protrude from the fifth wall 55 or the third wall 53.

I6. Modification 6:

In the above-described embodiments, the air intake part 47 has a cylindrical shape. However, the air intake part 47 does not necessarily have a cylindrical shape. The air intake part 47 only needs to have a communication hole that is in communication with the air flow channel 44. Also, the communication hole of the air intake part 47 may be closed by a filter member constituted by a moisture permeable waterproof sheet, a gas-liquid separation film, or the like so as to allow gas to pass through and prohibit liquid from passing through. Also, a flow channel that prevents the ink IK in the ink tank 21 from evaporating may be provided between the air intake part 47 and the air flow channel 44.

I7. Modification 7:

In the ink tank 21B according to the above-described second embodiment, the ink container part 43 has the recessed portion 67 that can retain ink IK when the ink tank 21B is in the second orientation. The configuration of the recessed portion 67 according to the second embodiment may be applied to the ink container part 43 of the ink tank 21 according to the other embodiments. The ink tank 21F according to the sixth embodiment and the ink tank 21H according to the eighth embodiment described above has the plurality of divided buffer parts 45*s* divided from the buffer part 45. The configuration of the plurality of divided buffer parts 45*s* according to the sixth embodiment may be applied to the ink tank 21 according to the other embodiments.

I8. Modification 8:

In the above-described embodiments, the printer 10 is provided with four ink tanks 21. However, the printer 10 may be provided with only one ink tank 21, or two or three ink tanks 21. Alternatively, the printer 10 may be provided with four or more ink tanks 21. In the above-described embodiments, the plurality of ink tanks 21 are configured as separate members. However, the ink tanks 21 may be integrally coupled to each other by sharing the fifth wall 55 and the sixth wall 56 between them, for example.

I9. Modification 9:

In the above-described embodiments, the ink tank 21 is housed in the casing 11 (FIGS. 11 and 12). However, the ink tank 21 may be disposed outside the casing 11, or housed in a casing of a tank unit that is provided separately from the printer 10.

I10. Modification 10:

In the ink tank 21G according to the seventh embodiment and the ink tank 21H according to the eighth embodiment, the arrangement of the ink container part 43, the buffer part 45, and the air flow channel 44 is substantially the same as in the ink tank 21A according to the first embodiment. However, the configuration in which the ink container part 43, the buffer part 45 and the air flow channel 44 are separated from each other, as in the ink tank 21G according to the seventh embodiment and the ink tank 21H according to the eighth embodiment, may be applied to the ink tank 21 according to the embodiments other than the first embodiment.

I11. Modification 11:

In the above-described embodiments, the printer 10 is configured as a serial printer that prints one dot each time using the carriage 32 that moves back and forth. However, the printer 10 may be configured as a printer other than a serial printer. The printer 10 may be configured as a line printer, for example.

I12. Modification 12:

In the above-described embodiments, a description is given of the configuration of the ink tank 21 that is configured to be able to supply ink to the printing head 33 included in the printer 10. However, the configuration of the ink tank 21 according to the above-described embodiments may be applied to a liquid container that stores a liquid that is to be supplied to a liquid ejection head included in a liquid ejection apparatus other than printers. For example, the configuration of the ink tank 21 may be applied to a detergent container for supplying detergent to a liquid ejection head of a detergent ejection apparatus that ejects detergent that is liquid. Also, the configuration of the ink tank 21 according to the above-described embodiments may be applied to a liquid container that supplies a liquid to a liquid consumption apparatus that consumes a liquid by a method other than ejection.

The invention is not limited to the above-described embodiments, examples, or modifications, and may be realized with various configurations without departing from the spirit of the invention. For example, technical features in the embodiments, examples, and modifications that correspond to technical features in the aspects described in the SUMMARY section can be replaced and combined as necessary in order to solve some or all of the above-described problems or achieve some or all of the above-described effects. Also, technical features not described as being essential in the specification can be omitted as necessary.

What is claimed is:

1. A liquid container for supplying a liquid to a liquid ejection head, comprising:

a liquid container part configured to store the liquid;

a liquid injection part,through which the liquid is injected to the liquid container part from an outside;

an air introduction part,through which outside air is introduced to the liquid container part and a buffer part that is in communication with the liquid container part via a first communication path, and in communication with the air introduction part via a second communication path, wherein when the liquid container is in a first orientation in which the liquid is supplied to the liquid ejection head at the time the liquid is to be ejected, a first opening end of the first communication path is located in an area in the liquid container part where air is present when the liquid occupies half the capacity of the liquid container part, the first opening end being an opening end of the liquid container part, and the buffer part, when the liquid container is in a second orientation that is rotated from the first orientation by 180°, is configured to store the liquid having a volume that is equal to or larger than a volume of the liquid in the liquid container part such that a surface of the liquid is located below a second opening end and a third opening end, the second opening end being an opening end of the first communication path in the buffer part, and the third opening end being an opening end of the second communication path in the buffer part.

2. The liquid container according to claim 1, wherein when the liquid container is in the first orientation, the first opening end of the first communication path is provided in an upper end portion located at an upper end of the liquid container part, and when the liquid container is in the first orientation, the second opening end is located in a lower end portion that is located at a lower end of the buffer part.

3. A liquid ejection apparatus comprising:

a liquid container according to claim 2;

a liquid ejection head to which the liquid is supplied from the liquid container; and an outer casing that houses the liquid container and the liquid ejection head, wherein the liquid container includes a visual check part that allows a user to visually check a liquid surface level of the liquid stored in the liquid container part, and the outer casing is provided with a window located at a position that directly faces the visual check part.

4. The liquid container according to claim 1, wherein when the liquid container is in the first orientation, the buffer part is located above the liquid container part.

5. A liquid ejection apparatus comprising:

a liquid container according to claim 4;

a liquid ejection head to which the liquid is supplied from the liquid container; and an outer casing that houses the liquid container and the liquid ejection head, wherein the liquid container includes a visual check part that allows a user to visually check a liquid surface level of the liquid stored in the liquid container part, and the outer casing is provided with a window located at a position that directly faces the visual check part.

6. The liquid container according to claim 1, wherein when the liquid container is in the first orientation, the buffer part is located below the liquid container part.

7. A liquid ejection apparatus comprising:

a liquid container according to claim 6;

a liquid ejection head to which the liquid is supplied from the liquid container; and an outer casing that houses the liquid container and the liquid ejection head, wherein the liquid container includes a visual check part that allows a user to visually check a liquid surface level of the liquid stored in the liquid container part, and the outer casing is provided with a window located at a position that directly faces the visual check part.

8. The liquid container according to claim 1, wherein when the liquid container is in the first orientation, the buffer part is located in a direction that vertically intersects the liquid container part.

9. A liquid ejection apparatus comprising:

a liquid container according to claim 8;

a liquid ejection head to which the liquid is supplied from the liquid container; and an outer casing that houses the liquid container and the liquid ejection head, wherein the liquid container includes a visual check part that allows a user to visually check a liquid surface level of the liquid stored in the liquid container part, and the outer casing is provided with a window located at a position that directly faces the visual check part.

10. The liquid container according to claim 1, wherein the air introduction part has an air intake part that is open outward, and when the liquid container is in the first orientation, the air intake part is located at the same level as or above the first opening end in the liquid container part.

11. A liquid ejection apparatus comprising:

a liquid container according to claim 10;

a liquid ejection head to which the liquid is supplied from the liquid container; and an outer casing that houses the liquid container and the liquid ejection head, wherein the liquid container includes a visual check part that allows a user to visually check a liquid surface level of the liquid stored in the liquid container part, and the outer casing is provided with a window located at a position that directly faces the visual check part.

12. The liquid container according to claim 1, wherein the buffer part includes a plurality of divided buffer parts that are in communication with each other, and when the liquid container is in the second orientation, a total volume of the liquid that is configured to be retained in the plurality of divided buffer parts is equal to or larger than the capacity of the liquid container part.

13. The liquid container according to claim 1, wherein the liquid container part and the buffer part are located adjacent to each other with a partition interposed between the liquid container part and the buffer part.

14. The liquid container according to claim 13, wherein when the liquid container is in the first orientation, the buffer part is located above the liquid container part with the partition interposed between the buffer part and the liquid container part, when the liquid container is in the first orientation, the partition includes a bottom surface that is a lower end surface of the buffer part and a top surface that is an upper end surface of the liquid container part, and the buffer part is communicated with the liquid container part through the first communication path on the partition.

15. The liquid container according to claim 1, wherein the air introduction part and the buffer part are located adjacent to each other with a partition wall interposed between the air introduction part and the buffer part.

16. The liquid container according to claim 15, when the liquid container is in the first orientation, the partition wall extends in a vertical direction, and the air introduction part is communicated with the buffer part through the second communication path on an end portion of the partition wall.

17. The liquid container according to claim 1, wherein the liquid container part is provided with a recessed portion that is separated from the first opening end of the liquid container part, and that is open upward when the liquid container is in the second orientation.

18. A liquid ejection apparatus comprising:

a liquid container according to claim 1;

a liquid ejection head to which the liquid is supplied from the liquid container; and an outer casing that houses the liquid container and the liquid ejection head, wherein the liquid container includes a visual check part that visually checks a liquid surface level of the liquid stored in the liquid container part, and the outer casing is included with a window located at a position that directly faces the visual check part.

19. The liquid ejection apparatus according to claim 18, wherein the visual check part includes an upper limit indicator configured to indicate a guide of an upper limit position of the liquid surface when the liquid container is in the first orientation, and when the liquid container is in the first orientation, the air introduction part is located above the upper limit indicator.

20. The liquid ejection apparatus according to claim 18, wherein a portion of an outer wall that is included in the outer casing is included with a lid member that is attached to a position that faces the liquid container housed in the outer casing, such that the lid member is openable and closeable, and the window is provided in the lid member.

* * * * *